US009851074B2

(12) United States Patent
Teder et al.

(10) Patent No.: US 9,851,074 B2
(45) Date of Patent: Dec. 26, 2017

(54) SURGICAL ILLUMINATOR

(71) Applicants: Rein Teder, Bloomington, MN (US); Roger William Heegaard, St. Paul, MN (US)

(72) Inventors: Rein Teder, Bloomington, MN (US); Roger William Heegaard, St. Paul, MN (US)

(73) Assignee: Enova Illumination, LLC, Minneapolis, MN (US)

( * ) Notice: Subject to any disclaimer, the term of this patent is extended or adjusted under 35 U.S.C. 154(b) by 64 days.

(21) Appl. No.: 15/150,951

(22) Filed: May 10, 2016

(65) Prior Publication Data

US 2017/0299152 A1 Oct. 19, 2017

Related U.S. Application Data

(60) Provisional application No. 62/323,408, filed on Apr. 15, 2016.

(51) Int. Cl.

| | |
|---|---|
| ***F21V 13/00*** | (2006.01) |
| ***F21V 14/06*** | (2006.01) |
| ***F21V 23/00*** | (2015.01) |
| ***F21V 5/00*** | (2015.01) |
| ***F21L 4/02*** | (2006.01) |
| ***F21V 29/74*** | (2015.01) |
| *F21W 131/205* | (2006.01) |
| *F21Y 101/02* | (2006.01) |

(52) U.S. Cl.

CPC ..... *F21V 14/065* (2013.01); *F21L 4/02* (2013.01); *F21V 5/007* (2013.01); *F21V 23/005* (2013.01); *F21V 29/74* (2015.01); *F21W 2131/205* (2013.01); *F21Y 2101/02* (2013.01)

(58) Field of Classification Search

CPC ..... F21V 14/065; F21V 29/74; F21V 5/007; F21V 23/005; F21L 4/02; F21W 2131/205

See application file for complete search history.

(56) References Cited

U.S. PATENT DOCUMENTS

| | | | |
|---|---|---|---|
| 3,285,242 | A | 11/1966 | Wallace et al. |
| 3,665,451 | A | 5/1972 | Keith et al. |
| 4,104,709 | A | 8/1978 | Kloots |
| 4,288,844 | A | 9/1981 | Fisher et al. |
| 4,516,190 | A | 5/1985 | Kloots |
| 4,631,644 | A | 12/1986 | Dannhauer |
| 4,631,645 | A | 12/1986 | Lenart |
| 4,794,496 | A | 12/1988 | Lanes et al. |
| 5,115,382 | A | 5/1992 | Smith |
| 5,163,420 | A | 11/1992 | Van Der Bel |
| 5,355,285 | A | 10/1994 | Hicks |
| 5,430,620 | A | 7/1995 | Li et al. |
| 5,667,291 | A | 9/1997 | Caplan et al. |
| 5,709,459 | A | 1/1998 | Gourgouliatos et al. |
| 5,722,762 | A | 3/1998 | Soll |

(Continued)

*Primary Examiner* — Evan Dzierzynski

(74) *Attorney, Agent, or Firm* — Mitchell A. Rossman; Terra Nova Patent Law, PLLC

(57) ABSTRACT

The present invention provides a surgical illuminator. The surgical illuminator includes a base, a guide barrel, a cam barrel, a grip ring, a lens barrel, a printed circuit board having three light emitting diodes, a triple aspheric lens, a first lens mask, a triple double-convex lens and a triple double-convex lens. Methods of using the surgical illuminator are also provided.

20 Claims, 19 Drawing Sheets

(56) References Cited

U.S. PATENT DOCUMENTS

| | | | | |
|---|---|---|---|---|
| 5,742,392 | A | 4/1998 | Anderson et al. | |
| 5,774,271 | A | 6/1998 | Lagerway et al. | |
| 5,871,268 | A | 2/1999 | Edens et al. | |
| 6,127,783 | A | 10/2000 | Pashley et al. | |
| 6,224,227 | B1 | 5/2001 | Klootz | |
| 6,290,382 | B1 | 9/2001 | Bourn et al. | |
| 6,402,347 | B1 | 6/2002 | Maas et al. | |
| 6,554,444 | B2 | 4/2003 | Shimada et al. | |
| 6,896,389 | B1 | 5/2005 | Paul | |
| 6,955,444 | B2 | 10/2005 | Gupta | |
| 7,041,054 | B2 | 5/2006 | Klootz | |
| 7,134,763 | B2 | 11/2006 | Klootz | |
| 7,163,327 | B2 | 1/2007 | Henson et al. | |
| 7,192,151 | B2 | 3/2007 | Clupper et al. | |
| 7,210,810 | B1 | 5/2007 | Iversen et al. | |
| 7,234,831 | B1 | 6/2007 | Hanley | |
| D553,277 | S | 10/2007 | Ho et al. | |
| 7,425,077 | B2 | 9/2008 | Lockamy et al. | |
| 7,490,949 | B2 | 2/2009 | Medinis | |
| 7,645,050 | B2 | 1/2010 | Wilt et al. | |
| 7,690,806 | B2 | 4/2010 | Feinbloom et al. | |
| 7,758,204 | B2 | 7/2010 | Klipstein et al. | |
| 7,815,342 | B2 | 10/2010 | Medinis | |
| 7,824,089 | B2 | 11/2010 | Charles | |
| 7,841,741 | B2 | 11/2010 | Chan et al. | |
| 7,883,233 | B2 | 2/2011 | Feinbloom et al. | |
| 9,271,636 | B2 | 3/2016 | Teder et al. | |
| 2006/0039160 | A1 | 2/2006 | Cassarly et al. | |
| 2006/0285315 | A1 | 12/2006 | Tufenkjian | |
| 2008/0144306 | A1 | 6/2008 | Medinis | |
| 2010/0091485 | A1* | 4/2010 | Matthews | F21L 4/027 362/234 |
| 2011/0122598 | A1 | 5/2011 | Chang | |
| 2013/0286639 | A1* | 10/2013 | Choo | F21L 4/005 362/187 |
| 2014/0334159 | A1 | 11/2014 | Ferguson | |
| 2015/0252983 | A1* | 9/2015 | Lee | F21V 14/065 362/109 |

* cited by examiner

SURGICAL ILLUMINATOR

RELATED APPLICATIONS

This application claims priority to U.S. Provisional Patent Application Ser. No. 62/323,408 filed Apr. 15, 2016, which is hereby incorporated by reference in its entirety for all purposes.

BACKGROUND OF THE INVENTION

High quality illumination is essential in medical applications, particularly in a surgical environment. Uneven illumination over the field of view may cause a surgeon to perceive problems that do not actually exist in the patient. Further, illumination anomalies and artifacts clutter and may distort the doctor's field of view, and may thus cause the doctor to miss details critical to the doctor's performance. Stray light beyond the desired illumination field distracts the doctor. Also, it is highly desirable to be able to adjust the spot of the illumination, so that only the area under consideration is seen by the doctor. Thus, medical professionals have long sought the best possible illumination in pursuit of the best possible outcomes.

With the advent of high power, light emitting diodes (LEDs), medical illuminators have used these devices as a light source. The light emitting diode based systems have the difficulty that the light source, the light emitting diode die, is typically square. Moreover, the top of the light emitting diode die invariably has some form of connecting wires, metallization or other structures to conduct electricity into the silicon. These conductors are generally not visible in typical light emitting diodes deployments where light emitting diodes illuminate a broad field. In a surgical illuminator, however, that images the light emitting diode onto the viewing surface, the light emitting diode die conductors are clearly visible and they degrade the light quality. The light emitting diode based surgical illuminators typically image the light emitting diode die onto the viewing plane to achieve a small spot size, and thus the spot is either a square or show at least the remnants of that square. Most doctors that use illuminators have been trained using fiber-optic illumination systems that emit circular illuminated spots. They are used to seeing bright circles, and prefer them.

While light emitting diodes are generally more efficient than incandescent sources, they still generate considerable heat. Inefficient dissipation of the heat can cause failure or degradation of the light emitting diode. Further, if the case of the illuminator gets hot, it can become difficult to touch. This can cause operator discomfort, as well as making it difficult to adjust or aim the beam by touching and moving the case.

What is needed is a surgical illuminator that avoids the deficiencies of the prior art.

SUMMARY OF THE INVENTION

The present invention provides a surgical illuminator that produces a clear, bright and adjustable spot without illumination anomalies and artifacts. The surgical illuminator is specifically designed for narrow depth of focus about the light emitting die and delivers a round spot on the viewing plane, with sharp edges. The optical efficiency of the surgical illuminator is high, and thus the spot is bright. The spot is free from the uneven illumination that has limited the acceptance of many light emitting diode based surgical illuminators. Further, the surgical illuminator is designed for thermal efficiency, yielding good light emitting diode life and no difficulties in touching the product during operation. Taken as a whole, the surgical illuminator produces performance that is on par with the fiber-optic illumination systems that surgeons are used to.

The enhanced performance of the surgical illuminator permits advancements in medical care. Surgeons have long found the fiber-optic tether of conventional systems to be uncomfortable, fatiguing, and restrictive. Thus, the surgical illuminator helps facilitate long surgeries. Further, many scenarios could benefit from surgical-suite quality lighting in a mobile situation. These scenarios include developing nations, emergency response, and field-military deployments.

The present invention provides a surgical illuminator with a round, adjustable beam, with high brightness and a clear field of view. The surgical illuminator produces an illumination spot this is free from illumination artifacts present on the light emitting diode die, which is the source of the illumination. Further, the surgical illuminator provides good cooling for the light emitting diode, yet provides that the beam adjustment mechanism not require that the user touch a hot surface.

The present invention provides a surgical illuminator. The surgical illuminator includes a base, a guide barrel, a cam barrel, a grip ring, a lens barrel, a printed circuit board having three light emitting diodes, a triple aspheric lens, a first lens mask, a triple double-convex lens and a triple double-convex lens. Methods of using the surgical illuminator are also provided.

The present invention provides a surgical illuminator. The surgical illuminator includes a base having a proximal end, a distal end, a first surface, a second surface, and a third surface; a guide barrel having a proximal end, a distal end, a first surface, and a second surface, wherein the first surface of the guide barrel is adjacent to the third surface of the base, wherein the second surface of the guide barrel is configured to accept a first surface of a cam barrel having a proximal end, a distal end, a first surface, and a second surface, wherein the cam barrel includes one or more helical slots each independently spanning about 270 degrees, wherein the guide barrel and the cam barrel are each independently configured to accept a cam roller; a grip ring having a proximal end, a distal end, a first surface, and a second surface, wherein the first surface of the grip ring is configured to accept the second surface of the cam barrel; a lens barrel having a proximal end, a distal end a first surface, and a second surface, wherein the first surface of the lens barrel is configured to retain a first lens mask having a proximal end and a distal end, wherein the second surface of the lens barrel is adjacent to the first surface of the guide barrel; a printed circuit board having a first surface and a second surface, wherein the first surface of the printed circuit board includes three symmetrically distributed light emitting diodes, wherein the second surface of the printed circuit board is facing the first surface of the base, wherein the first surface of the printed circuit board is facing the distal end of the first lens mask; a triple aspheric lens having a proximal end, a distal end, a first surface, a second surface, and a third surface, wherein the second surface of the triple aspheric lens is planar and in contact with the proximal end of the first lens mask, wherein the first surface of the triple aspheric lens includes three symmetrically distributed convex surfaces; a second lens mask having a proximal end, a distal end, a first surface, and a second surface, wherein the second lens mask is configured to accept three convex surfaces of the triple aspheric lens; a triple double-convex lens having a proximal end, a distal end a first surface, a second surface, and a third surface, wherein the triple double-convex lens includes three symmetrically distributed double-convex surfaces, wherein the distal end of the triple double-convex lens is adjacent to the proximal end of the second lens mask; a triple double-convex lens housing having a proximal end, a distal end, a first surface, a second surface, and a third surface, wherein the triple double-convex lens is mounted axially inside the triple double-convex lens housing so that the third surface of the triple double-convex lens is adjacent to the first surface of the triple double-convex lens housing, and wherein the first surface of the triple double-convex lens housing is configured to accept the second surface of the lens barrel.

In one embodiment, the guide barrel and the cam barrel are each independently configured to accept a cam roller extending through the guide barrel and the cam barrel. In one embodiment, the second surface of the grip ring includes a knurled surface. In one embodiment, the first lens mask includes a symmetrical three 3-prong first lens mask. In one embodiment, the second surface of the lens barrel is adjacent to the first surface of the guide barrel. In one embodiment, the second lens mask includes a symmetrical 3-prong second lens mask. In one embodiment, the three symmetrically distributed light emitting diodes each independently feature about an 80 degree radiation pattern, and maximum forward current of about 800 mA. In one embodiment, the three symmetrically distributed light emitting diodes each independently operate with a current of about 100 mA to about 800 mA. In one embodiment, the surgical illuminator further includes a power source operatively connected to the printed circuit board and an on/off switch.

In one embodiment, the distance (Do) between the second surface of the printed circuit board and the planar surface of the triple aspheric lens is about 8 mm. In one embodiment, each of the symmetrically distributed convex surfaces of the triple aspheric lens each independently has a diameter of about 16 mm and a focal length of about 17.5 mm. In one embodiment, each of the symmetrically distributed convex surfaces of the triple double-convex lens has a diameter of about 18 mm and a focal length of about 75 mm. In one embodiment, the surgical illuminator further includes a heat sink having a proximal end, a distal end, a first surface, and a second surface. In one embodiment, the first surface of the heat sink is configured to accept an O-ring. In one embodiment, the second surface of the heat sink includes one or more cooling fins. In one embodiment, the surgical illuminator further includes one or more filters detachably and axially mounted to the proximal end of the triple double-convex lens housing.

The present invention provides a surgical illuminator. The surgical illuminator includes a cylindrical base having a proximal end, a distal end, a first surface, a second surface, and a third surface; a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel includes one or more helical slots each independently spanning about 270 degrees, wherein the cylindrical guide barrel and the cylindrical cam barrel are each independently configured to accept a cam roller extending through the cylindrical guide barrel and the cylindrical cam barrel; a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring includes a knurled surface; a cylindrical lens barrel having a proximal end, a distal end, a first surface, and a second surface, wherein the first surface of the cylindrical lens barrel is configured to retain a first lens mask having a proximal end and a distal end, wherein the first lens mask includes a symmetrical three 3-prong first lens mask; wherein the second surface of the cylindrical lens barrel is adjacent to the first surface of the cylindrical guide barrel, a printed circuit board having a first surface and a second surface, wherein the first surface of the printed circuit board includes three symmetrically distributed light emitting diodes, wherein the second surface of the printed circuit board is facing the first surface of the cylindrical base, wherein the first surface of the printed circuit board is facing the distal end of the first lens mask; a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens includes three symmetrically distributed convex surfaces; a second lens mask having a proximal end, a distal end, a first surface, and a second surface, wherein the second lens mask is configured to accept three convex surfaces of the triple aspheric cylindrical lens, wherein the second lens mask includes a symmetrical 3-prong second lens mask; a triple double-convex cylindrical lens having a proximal end, a distal end, a first surface, a second surface, and a third surface, wherein the triple double-convex cylindrical lens includes three symmetrically distributed double-convex surfaces, wherein the distal end of the triple double-convex cylindrical lens is adjacent to the proximal end of the second lens mask; a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel.

In one embodiment, the three symmetrically distributed light emitting diodes each independently feature about an 80 degree radiation pattern, and maximum forward current of about 800 mA. In one embodiment, the three symmetrically distributed light emitting diodes each independently operate with a current of about 100 mA to about 800 mA. In one embodiment, the surgical illuminator further includes a power source operatively connected to the printed circuit board and an on/off switch. In one embodiment, the distance (Do) between the second surface of the printed circuit board and the planar surface of the triple aspheric cylindrical lens is from about 8 mm. In one embodiment, each of the symmetrically distributed convex surfaces of the triple aspheric cylindrical lens each independently has a diameter of about 16 mm and a focal length of about 17.5 mm. In one embodiment, each of the symmetrically distributed convex surfaces of the triple double-convex cylindrical lens has a diameter of about 18 mm and a focal length of about 75 mm. In one embodiment, the surgical illuminator further includes a heat sink having a proximal end, a distal end, a first surface, and a second surface. In one embodiment, the first surface of the heat sink is configured to accept an O-ring. In one embodiment, the second surface of the heat sink includes one or more cooling fins. In one embodiment, the surgical illuminator further includes one or more filters detachably and axially mounted to the proximal end of the triple double-convex cylindrical lens housing.

The present invention provides a surgical illuminator. The surgical illuminator includes a heat sink having a proximal end, a distal end, a first surface, and a second surface, wherein the first surface of the heat sink is configured to accept an O-ring, wherein the second surface of the heat sink includes one or more cooling fins; a cylindrical base having a proximal end, a distal end, a first surface, a second surface, and a third surface, wherein the second surface of the cylindrical base is facing the first surface of the heat sink; a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel includes one or more helical slots each independently spanning about 270 degrees, wherein the cylindrical guide barrel and the cylindrical cam barrel are each independently configured to accept a cam roller extending through the cylindrical guide barrel and the cylindrical cam barrel; a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring includes a knurled surface; a cylindrical lens barrel having a proximal end, a distal end, a first surface, and a second surface, wherein the first surface of the cylindrical lens barrel is configured to retain a first lens mask having a proximal end and a distal end, wherein the first lens mask includes a symmetrical three 3-prong first lens mask; wherein the second surface of the cylindrical lens barrel is adjacent to the first surface of the cylindrical guide barrel; a printed circuit board having a first surface and a second surface, wherein the first surface of the printed circuit board includes three symmetrically distributed light emitting diodes, wherein the second surface of the printed circuit board is facing the first surface of the cylindrical base, wherein the first surface of the printed circuit board is facing the distal end of the first lens mask; a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens includes three symmetrically distributed convex surfaces; a second lens mask having a proximal end, a distal end, a first surface, and a second surface, wherein the second lens mask is configured to accept three convex surfaces of the triple aspheric cylindrical lens, wherein the second lens mask includes a symmetrical 3-prong second lens mask; a triple double-convex cylindrical lens having a proximal end, a distal end, a first surface, a second surface, and a third surface, wherein the triple double-convex cylindrical lens includes three symmetrically distributed double-convex surfaces, wherein the distal end of the triple double-convex cylindrical lens is adjacent to the proximal end of the second lens mask; a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel.

The present invention provides a method of using a surgical illuminator. The method includes: providing a surgical illuminator including; a base having a proximal end, a distal end, a first surface, a second surface, and a third surface; a guide barrel having a proximal end, a distal end, a first surface, and a second surface, wherein the first surface of the guide barrel is adjacent to the third surface of the base, wherein the second surface of the guide barrel is configured to accept a first surface of a cam barrel having a proximal end, a distal end, a first surface, and a second surface, wherein the cam barrel includes one or more helical slots each independently spanning about 270 degrees, wherein the guide barrel and the cam barrel are each independently configured to accept a cam roller; a grip ring having a proximal end, a distal end, a first surface, and a second surface, wherein the first surface of the grip ring is configured to accept the second surface of the cam barrel; a lens barrel having a proximal end, a distal end, a first surface, and a second surface, wherein the first surface of the lens barrel is configured to retain a first lens mask having a proximal end and a distal end, wherein the second surface of the lens barrel is adjacent to the first surface of the guide barrel; a printed circuit board having a first surface and a second surface, wherein the first surface of the printed circuit board includes three symmetrically distributed light emitting diodes, wherein the second surface of the printed circuit board is facing the first surface of the base, wherein the first surface of the printed circuit board is facing the distal end of the first lens mask; a triple aspheric lens having a proximal end, a distal end, a first surface, a second surface, and a third surface, wherein the second surface of the triple aspheric lens is planar and in contact with the proximal end of the first lens mask, wherein the first surface of the triple aspheric lens includes three symmetrically distributed convex surfaces; a second lens mask having a proximal end, a distal end, a first surface, and a second surface, wherein the second lens mask is configured to accept three convex surfaces of the triple aspheric lens; a triple double-convex lens having a proximal end, a distal end, a first surface, a second surface, and a third surface, wherein the triple double-convex lens includes three symmetrically distributed double-convex surfaces, wherein the distal end of the triple double-convex lens is adjacent to the proximal end of the second lens mask; a triple double-convex lens housing having a proximal end, a distal end, a first surface, a second surface, and a third surface, wherein the triple double-convex lens is mounted axially inside the triple double-convex lens housing so that the third surface of the triple double-convex lens is adjacent to the first surface of the triple double-convex lens housing, and wherein the first surface of the triple double-convex lens housing is configured to accept the second surface of the lens barrel; attaching the surgical illuminator to the head of a surgeon; turning on the surgical illuminator; and illuminating an object.

The present invention provides a method of using a surgical illuminator. The method includes: providing a surgical illuminator including; a cylindrical base having a proximal end, a distal end, a first surface, a second surface, and a third surface; a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel includes one or more helical slots each independently spanning about 270 degrees, wherein the cylindrical guide barrel and the cylindrical cam barrel are each independently configured to accept a cam roller extending through the cylindrical guide barrel and the cylindrical cam barrel; a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring includes a knurled surface; a cylindrical lens barrel having a proximal end, a distal end, a first surface, and a second surface, wherein the first surface of the cylindrical lens barrel is configured to retain a first lens mask having a proximal end and a distal end, wherein the first lens mask includes a symmetrical three 3-prong first lens mask; wherein the second surface of the cylindrical lens barrel is adjacent to the first surface of the cylindrical guide barrel; a printed circuit board having a first surface and a second surface, wherein the first surface of the printed circuit board includes three symmetrically distributed light emitting diodes, wherein the second surface of the printed circuit board is facing the first surface of the cylindrical base, wherein the first surface of the printed circuit board is facing the distal end of the first lens mask; a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens includes three symmetrically distributed convex surfaces; a second lens mask having a proximal end, a distal end, a first surface, and a second surface, wherein the second lens mask is configured to accept three convex surfaces of the triple aspheric cylindrical lens, wherein the second lens mask includes a symmetrical 3-prong second lens mask; a triple double-convex cylindrical lens having a proximal end, a distal end, a first surface, a second surface, and a third surface, wherein the triple double-convex cylindrical lens includes three symmetrically distributed double-convex surfaces, wherein the distal end of the triple double-convex cylindrical lens is adjacent to the proximal end of the second lens mask; a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel; attaching the surgical illuminator to the head of a surgeon; turning on the surgical illuminator; and illuminating an object.

The present invention provides a method of using a surgical illuminator. The method includes: providing a surgical illuminator including; a heat sink having a proximal end, a distal end, a first surface, and a second surface, wherein the first surface of the heat sink is configured to accept an O-ring, wherein the second surface of the heat sink includes one or more cooling fins; a cylindrical base having a proximal end, a distal end, a first surface, a second surface, and a third surface, wherein the second surface of the cylindrical base is facing the first surface of the heat sink; a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel includes one or more helical slots each independently spanning about 270 degrees, wherein the cylindrical guide barrel and the cylindrical cam barrel are each independently configured to accept a cam roller extending through the cylindrical guide barrel and the cylindrical cam barrel; a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring includes a knurled surface; a cylindrical lens barrel having a proximal end, a distal end, a first surface, and a second surface, wherein the first surface of the cylindrical lens barrel is configured to retain a first lens mask having a proximal end and a distal end, wherein the first lens mask includes a symmetrical three 3-prong first lens mask; wherein the second surface of the cylindrical lens barrel is adjacent to the first surface of the cylindrical guide barrel; a printed circuit board having a first surface and a second surface, wherein the first surface of the printed circuit board includes three symmetrically distributed light emitting diodes, wherein the second surface of the printed circuit board is facing the first surface of the cylindrical base, wherein the first surface of the printed circuit board is facing the distal end of the first lens mask; a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens includes three symmetrically distributed convex surfaces; a second lens mask having a proximal end, a distal end, a first surface, and a second surface, wherein the second lens mask is configured to accept three convex surfaces of the triple aspheric cylindrical lens, wherein the second lens mask includes a symmetrical 3-prong second lens mask; a triple double-convex cylindrical lens having a proximal end, a distal end, a first surface, a second surface, and a third surface, wherein the triple double-convex cylindrical lens includes three symmetrically distributed double-convex surfaces, wherein the distal end of the triple double-convex cylindrical lens is adjacent to the proximal end of the second lens mask, a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel; attaching the surgical illuminator to the head of a surgeon; turning on the surgical illuminator; and illuminating an object.

BRIEF DESCRIPTION OF THE DRAWINGS

Embodiments of the invention may be best understood by referring to the following description and accompanying drawings, which illustrate such embodiments.

In the drawings.

Figure 1:
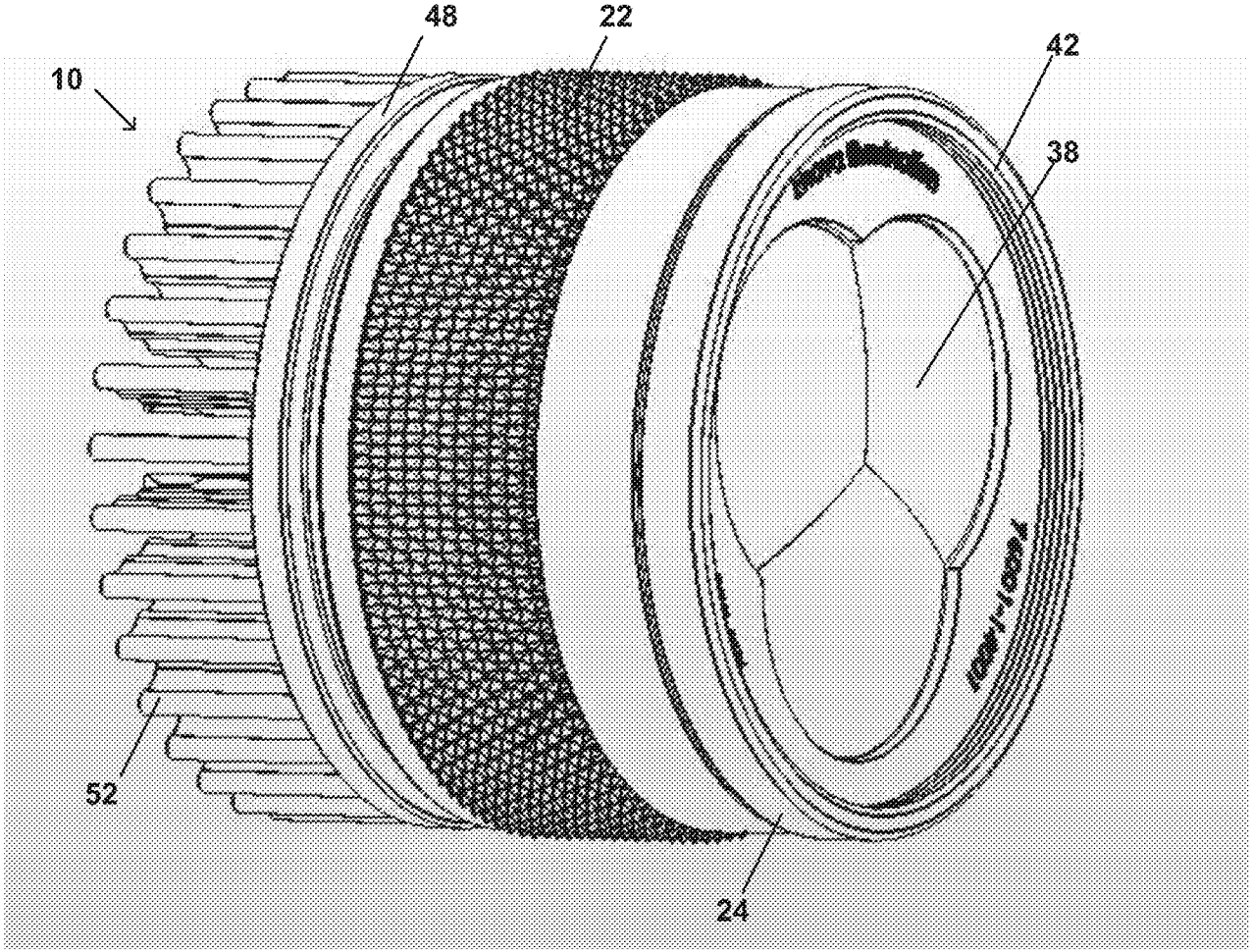
FIG. 1 is a perspective-view drawing illustrating an exemplary surgical illuminator.
Figure 2:
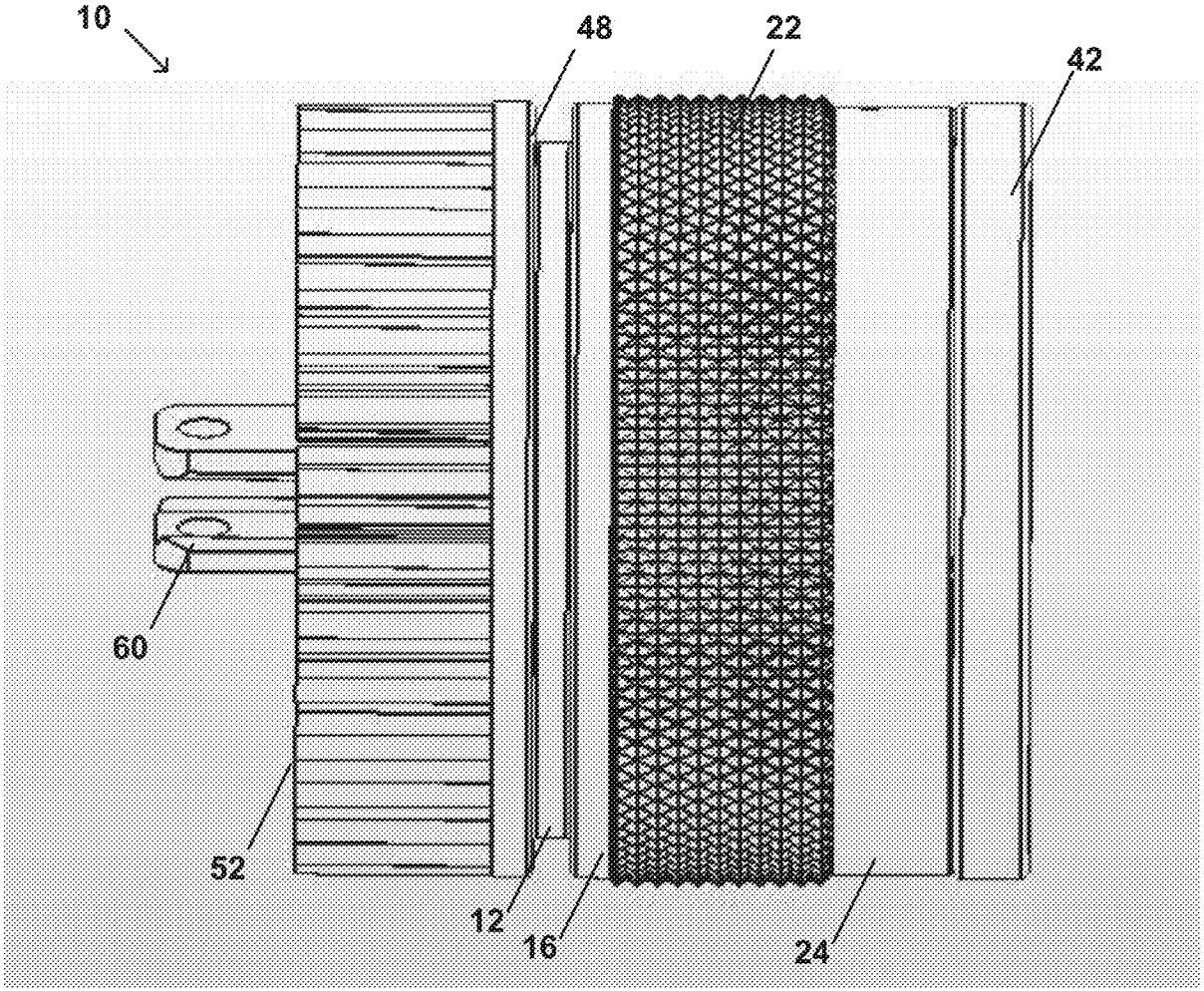
FIG. 2 is a side-view drawing illustrating an exemplary surgical illuminator.
Figure 3:
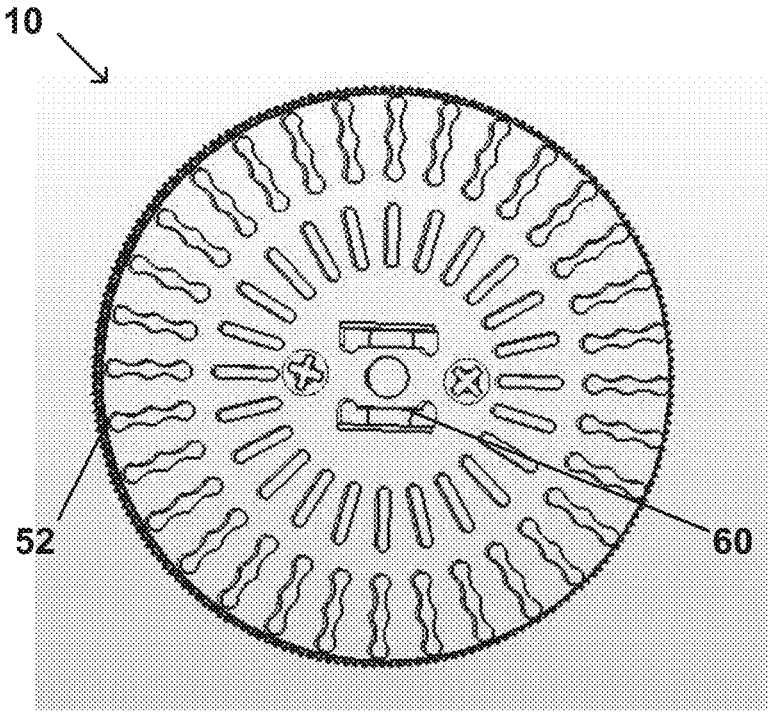
FIG. 3 is a bottom-view drawing illustrating an exemplary surgical illuminator.
Figure 4:
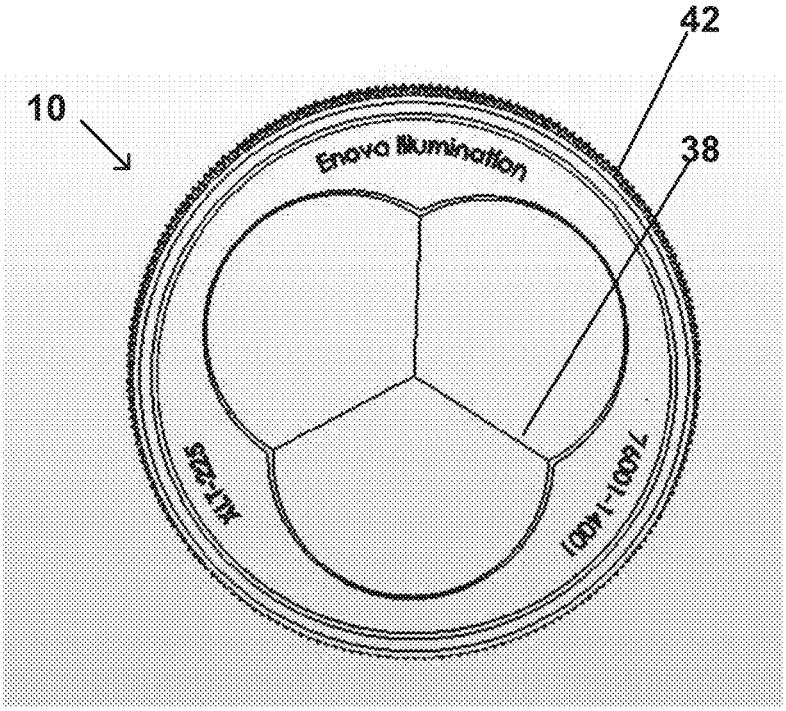
FIG. 4 is a top-view drawing illustrating an exemplary surgical illuminator.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a surgical illuminator. The surgical illuminator includes a base, a guide barrel, a cam barrel, a grip ring, a lens barrel, a printed circuit board having three light emitting diodes, a triple aspheric lens, a first lens mask, a triple double-convex lens and a triple double-convex lens. Methods of using the surgical illuminator are also provided.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "Di" refers to the distance from the double-convex lens to the image focal point.

As used herein, the term "Do" refers to the distance from the light emitting diode to the triple aspheric lens.

As used herein, the term "electromagnetic radiation" refers to a series of waves that are propagated by simultaneous periodic variations of electric and magnetic field intensity and that include radio waves, infrared, visible light, ultraviolet, X rays, and gamma rays.

As used herein, the terms "include," "for example," "such as," and the like are used illustratively and are not intended to limit the present invention.

As used herein, the term "light" refers to an electromagnetic radiation in the wavelength range including infrared, visible, ultraviolet, and X rays.

As used herein, the phrase "light emitting diode" or "LED" refers to a diode that emits light, whether visible, ultraviolet, or infrared, and whether coherent or incoherent. The term as used herein includes incoherent epoxy-encased semiconductor devices marketed as used herein, "LEDs," whether of the conventional or super-radiant variety. The term as used herein also includes semiconductor laser diodes.

As used herein, the term "optical" refers to electromagnetic radiation in the infrared, visible and ultra violet frequency region of the electromagnetic spectrum.

As used herein, the term "optical filter" is intended to mean a device for selectively passing or rejecting passage of radiation in a wavelength, polarization or frequency dependent manner. The term can include an interference filter in which multiple layers of dielectric materials pass or reflect radiation according to constructive or destructive interference between reflections from the various layers. Interference filters are also referred to in the art as dichroic filters, or dielectric filters. The term can include an absorptive filter which prevents passage of radiation having a selective wavelength or wavelength range by absorption. Absorptive filters include, for example, colored glass or liquid.

As used herein, the term "color optical filter" is used to describe an optical component having a surface on which a plurality of different "micro filters" (having different pass bands) is disposed. Suitable color optical filters include, for example, dielectric filters and pigmented transparent filters.

As used herein, the phrase "operatively coupled" refers to bringing two or more items together or into relationship with each other such that they may operate together or allow transfer of information between the two or more items.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used in the drawings herein, the proximal ends are on the right of the components and the distal ends are on the left side of the components. For the tubular cylindrical components, the first surface is the interior surface and the second surface is the exterior surface. For the other components, the first surface is on the right side of the component and the second surface is toward the left of the component.

As used herein, the phrase "polarizing filter" refers to a filter that filters incoming light to emit substantially only polarized light.

As used herein, the term "substantially," means at least 75 percent, preferably 90 percent, and most preferably at least 95 percent.

As used herein, the terms "surgeon" and "doctor" refers to any user of the head-mounted surgical illuminator as disclosed herein.

As used herein, the term "visible light" refers to light that is perceptible to the unaided human eye, generally in the wavelength range from about 400 to 700 nm.

As used herein, the term "ultraviolet radiation" refers to radiation whose wavelength is in the range from about 80 nm to about 400 nm.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

FIGS. 1-4 are a perspective-view drawing, a top-view drawing, a bottom-view drawing, and a side-view drawing, respectively, each drawing illustrating an exemplary surgical illuminator 10. The surgical illuminator 10 includes a base 12, a guide barrel (not shown), a cam barrel 16, a grip ring 22, a lens barrel 24, a printed circuit board having three light emitting diodes (not shown), a triple aspheric lens (not shown), a first lens mask (not shown), a triple double-convex lens 38, a triple double-convex lens housing 42, a heat sink 48, cooling fins 52, and an electrical plug 60.

Figure 5:
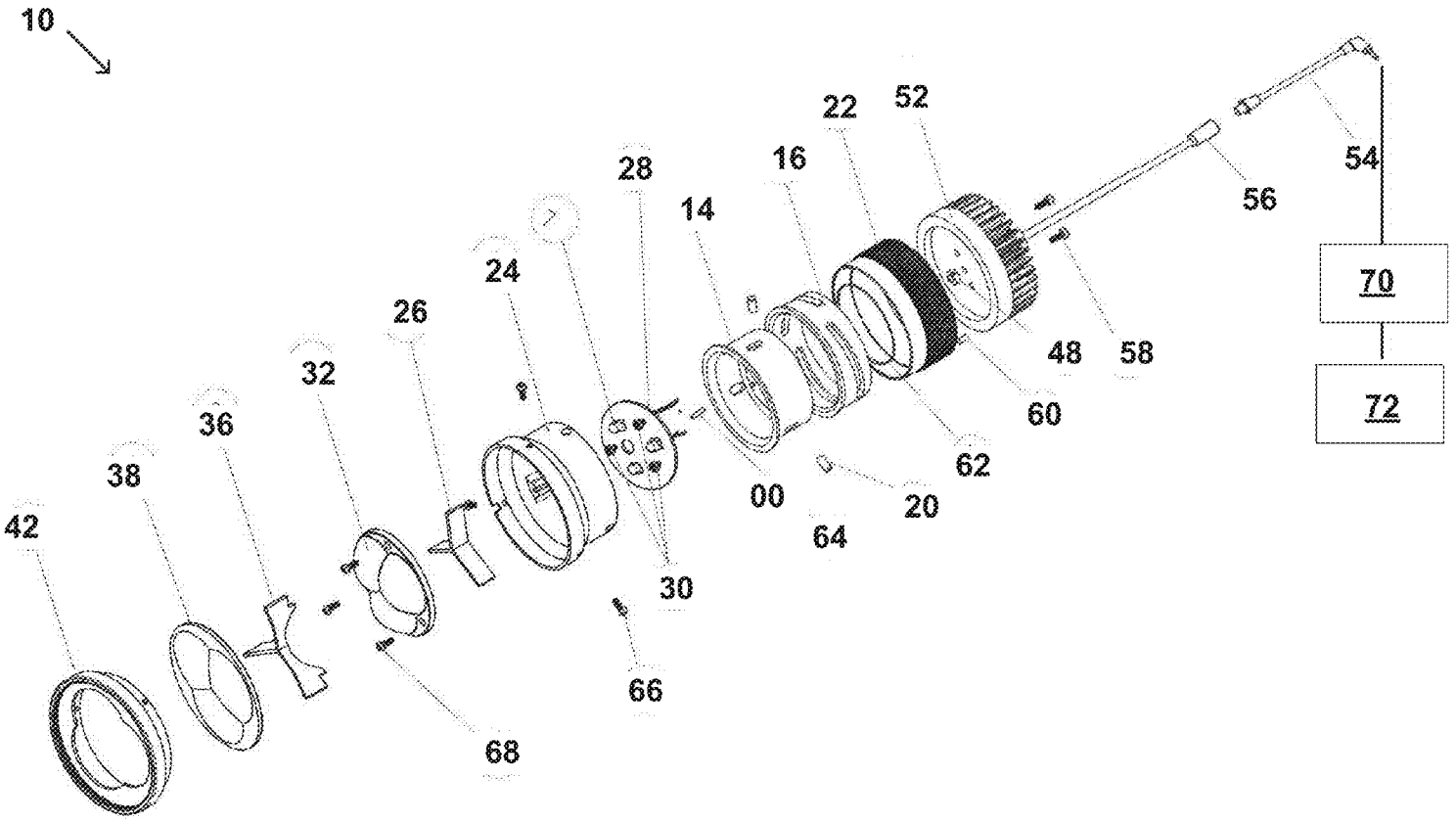
FIG. 5 is an exploded perspective-view drawing illustrating an exemplary surgical illuminator.

FIG. 5 is an exploded perspective side-view drawing illustrating an exemplar) surgical illuminator 10. The surgical illuminator 100 includes a base (not shown), a guide barrel 14, a cam barrel 16, a cam roller 20, a grip ring 22, a lens barrel 24, a first lens mask 26, a printed circuit board 28, three light emitting diodes (LEDs) 30, a triple aspheric lens 32, a second lens mask 36, a triple double-convex lens 38, a triple double-convex lens housing 42, a heat sink 48, cooling fins 52, an electrical plug 54, male plug-in 54, female plug-in 56, first screw 58, pressure ring 60, detention pin 62, tube 64, second screws 66, third screws 68, an on-off switch 70, and a power supply 72.

The base 12 has a proximal end, a distal end, a first surface, a second surface, and a third surface. The guide barrel 14 has a proximal end, a distal end, a first surface, and a second surface. The first surface of the guide barrel 14 is adjacent to the third surface of the base 12. The second surface of the guide barrel 14 is configured to accept a first surface of a cam barrel 16, which has a proximal end, a distal end, a first surface, and a second surface. The cam barrel 16 includes one or more helical slots 18 each independently spanning about 270 degrees. The guide barrel 14 and the cam barrel 16 are each independently configured to accept a cam roller 20, thereby allowing the cam barrel 16 to extend outward from the guide barrel 14. The grip ring 22 has a proximal end, a distal end, a first surface, and a second surface. The first surface of the grip ring 22 is configured to accept the second surface of the cam barrel 16. The lens barrel 24 has a proximal end, a distal end, a first surface, and a second surface. The first surface of the lens barrel 24 is configured to retain a first lens mask 26. The first lens mask 26 has a proximal end and a distal end. The second surface of the lens barrel 24 is adjacent to the first surface of the guide barrel 14. The printed circuit board 28 has a first surface and a second surface. The first surface of the printed circuit board 28 includes three symmetrically distributed light emitting diodes 30. The second surface of the printed circuit board 28 is facing the first surface of the base 12. The first surface of the printed circuit board 28 is facing the distal end of the first lens mask 26. The triple aspheric lens 32 has a proximal end, a distal end, a first surface, a second surface, and a third surface. The second surface of the triple aspheric lens 32 is planar and is in contact with the proximal end of the first lens mask 26. The first surface of the triple aspheric lens 32 includes three symmetrically distributed convex surfaces 34. The second lens mask 36 has a proximal end, a distal end, a first surface, and a second surface. The second lens mask 36 is configured to accept the three convex surfaces 34 of the triple aspheric lens 32. The triple double-convex lens 38 has a proximal end, a distal end, a first surface, a second surface, and a third surface. The triple double-convex lens 38 includes three symmetrically distributed double-convex surfaces 40. The distal end of the triple double-convex lens 38 is adjacent to the proximal end of the second lens mask 36. The triple double-convex lens housing 42 has a proximal end, a distal end, a first surface, a second surface, and a third surface. The triple double-convex lens 38 is mounted axially inside the triple double-convex lens housing 42 so that the third surface of the triple double-convex lens 38 is adjacent to the first surface of the triple double-convex lens housing 42. The first surface of the triple double-convex lens housing 42 is configured to accept the second surface of the lens barrel 24.

The guide barrel 14 and the cam barrel 16 are each independently configured to accept a cam roller 20 extending through the guide barrel 14 and the cam barrel 16.

In one embodiment, the second surface of the grip ring 22 includes a knurled surface. In one embodiment, the first lens mask 26 includes a symmetrical three 3-prong first lens mask. In one embodiment, the second surface of the lens barrel is adjacent to the first surface of the guide barrel. In one embodiment, the second lens mask includes a symmetrical 3-prong second lens mask. In one embodiment, the three light emitting diodes 30 each independently feature about an 80 degree radiation pattern, and maximum forward current of about 800 mA. In one embodiment, the three light emitting diodes 30 each independently operate with a current of about 100 mA to about 800 mA. In one embodiment, the surgical illuminator 10 includes a power source 72 operatively connected to the printed circuit board 28 and an on/off switch 70. In one embodiment, the distance (Do) between the first surface of the printed circuit board 28 and the planar surface of the triple aspheric lens 32 is about 8 mm. In one embodiment, each of the symmetrically distributed convex surfaces of the triple aspheric lens 32 each independently has a diameter of about 16 mm and a focal length of about 17.5 mm. In one embodiment, each of the symmetrically distributed convex surfaces of the triple double-convex lens 38 has a diameter of about 18 mm and a focal length of about 75 mm. In one embodiment, the surgical illuminator 10 includes one or more filters (not shown) detachably and axially mounted to the proximal end of the triple double-convex lens housing 42.

The surgical illuminator 10 has three optical systems all in very close proximity to each other. Each of the optical systems is tilted slightly towards a central axis, so they all illuminate a single spot. The illumination of the three lens systems is combined, making for three times the luminous intensity as could be achieved by a single system. Further, the surgical illuminator 10 is adjustable using a cam follower mechanism that permits the distance from the light emitting diode (LED) so the lens system to vary; but does not rotate the lens system with respect to the light emitting diodes (LEDs). As the distance is increased, the rays become over-focused, causing the illumination spot to become larger.

Each optical system take independently is similar to the optical system taught in U.S. Pat. No. 9,271,636. That is, a light emitting diode (LED) has a high power lens formed using the molded epoxy, causing the light emitting diode (LED) to emit a relatively narrow beam of light. For each light emitting diode (LED), a cone of rays strikes a planar surface of a planar-convex lens, decreasing the divergence of the cone of rays. The rays continue to an aspheric convex lens surface, essentially collimating the rays. The rays continue to a double-convex lens. The double-convex lens causes the rays to converge, forming a circular illumination pattern on the illumination plane.

However, unlike the system disclosed in U.S. Pat. No. 9,271,636, the present invention combines three such systems. The three nearly coxial optical systems are formed using injection molded lenses that allow them to be close proximity with no gaps between them. Each of them has an optical axis that is tilted 0.8 degrees in toward a rotational axis. Each produces a circular illumination pattern about six inches in diameter. Thus configured, the beams of all of three optical systems combine on the image plane. Because the three systems are so close to each other, the patterns overlap essentially perfectly, within the limits of perception to the user, even as the image plane is varied somewhat. Adjusted for small spot size, the distance between the printed circuit board 28 and the planar surface of the triple aspheric lens 32 is about 8 mm, and the illumination spot size is about 50 mm or 2 inches.

The triple aspheric lens 32 and the triple double-convex lens 38 are both mounted to a lens barrel 24. The spot size of the illuminator is adjusted by moving the lens barrel 24 closer and further from the light emitting diodes (LEDs) 30, which are mounted on the printed circuit board 28. This is accomplished with a zoom mechanism, somewhat similar to that of a camera zoom mechanism. The cam barrel 16 has lateral slots, as well as helical slots 18. A guide barrel 14 has just axial slots, and is secured to the base 12 using screws that also function as lateral guide screws. Cam rollers 20 are cylindrical pins that extend through the helical slots 18 in the cam barrel 16 as well as the axial slots in the guide barrel 14, and are secured into holes in lens barrel 24. A grip ring 22 is fastened to the cam barrel 16 using screws. Thus, the user is able to use the grip ring 22 to rotate the cam barrel 16 about a rotational axis. The cam barrel 16 cannot move axially (that is, along the axis of rotation) with respect to the base 12, because screw heads positioned within the lateral slots in the lens prevent this. The cam rollers 20 are held laterally captive by the axial slots in the guide barrel 14, but can move axial. Thus, when the cam barrel 16 rotates, cam rollers 20 are moved axial by the one or more helical slots 18 in the cam barrel 16. Lateral rotation of the cam rollers 20 is prevented by the axial slots of the guide barrel 14. This axial movement is transferred directly to the lens barrel 24 because the cam rollers 20 are secured into holes in the lens barrel 24. As configured, the lens barrel 24 moves axially with respect to the base 12. This axial movement of the lens barrel 24 thus causes the distance between the light emitting diodes (LEDs) 30 and the lenses to vary. By so adjusting the distance from light emitting diodes (LEDs) 30 to the triple aspheric lens 32, the optical system over-focuses the rays. This increases the spot size on the image plane. Increasing the distance by an additional 2 mm increases the illumination spot size to about 150 mm, or six inches.

The primary function of the operation of the surgical illuminator 10 is to get the rays to the proper places, and the secondary function is to conduct heat away from the die and into the ambient air. The printed circuit board 28 conducts heat to base 12, and some heat is additionally dissipated in the headlamp mounting bracket (not shown) to the headband. The base 12 conducts heat to lens barrel 24. The knurling on the grip ring 22, in addition to making it easy to grip, increases the surface area of the surgical illuminator 10, and thus its ability to dissipate heat. Further, the fins 52 additionally increase the surface area of the device.

The lens barrel 24 can be made up of numerous components to perform the functions described herein; one need not utilize a generally tubular lens barrel as shown in the figures. Other configurations for the lens barrel 24 will be evident to those skilled in art based on their common general knowledge and the principles described herein.

The lens barrel 24 can be machined, particularly if it is made from metal. The lens barrel 24 can be machined with a lathe such as a lathe or the like. Other materials for, and methods of manufacturing, the lens barrel 24 will be evident to those skilled in art based on their common general knowledge and the principles described herein.

The triple aspheric lens 32 and/or the triple double-convex lens 38 can be cast from a castable polymer such as acrylic, castable polycarbonate, or epoxy or the like. Both the triple aspheric lens 32 and the triple double-convex lens 38 are mounted axially within the lens barrel 24. Alternatively, the triple aspheric lens 32 and/or the triple double-convex lens 38 can be machined from a suitable material such as acrylic or thermoplastic polycarbonate and polished after machining. If the triple aspheric lens 32 and/or the triple double-convex lens 38 are machined, they can be machined by means of a lathe such as a lathe or the like. Further alternatively, the triple aspheric lens 32 and/or the triple double-convex lens 38 can be injection molded if shape distortions that occur during cooling can be avoided or fixed. The triple aspheric lens 32 and/or the triple double-convex lens 38 can alternatively be made of a non-polymer material such as glass or quartz, or made of a polymer by means other than casting, machining, or injection molding. Other methods of manufacturing the triple aspheric lens 32 and/or the triple double-convex lens 38 will be evident to those skilled in art based on their common general knowledge and the principles described herein.

The surgical illuminator 10 has a multi-conductor cable 54 to receive electrical power for the three light emitting diodes 30 from an external power source 70. A power source, such as, for example, a lithium-ion AA or AAA batteries, could be provided internal to the surgical illuminator 10. Suitable current limiting means can be utilized to control, limit or regulate the magnitude of current flowing through each of the three light emitting diodes 30 to protect each of the three light emitting diodes 30 from excessive current that can otherwise flow. Such current limiting means would be preferably located at or within the external power source, where used, to minimize the size of the surgical illuminator 10. The external power source 70 can be, for example, a battery pack with a switch and the current limiting means can be, for example, a resistor or a current regulator. Other means to receive power for the three light emitting diodes 30 will be evident to those skilled in art based on their common general knowledge and the principles described herein. As an example, the three light emitting diodes 30 could be directly connected to a battery power source within the surgical illuminator 10.

Figure 6:
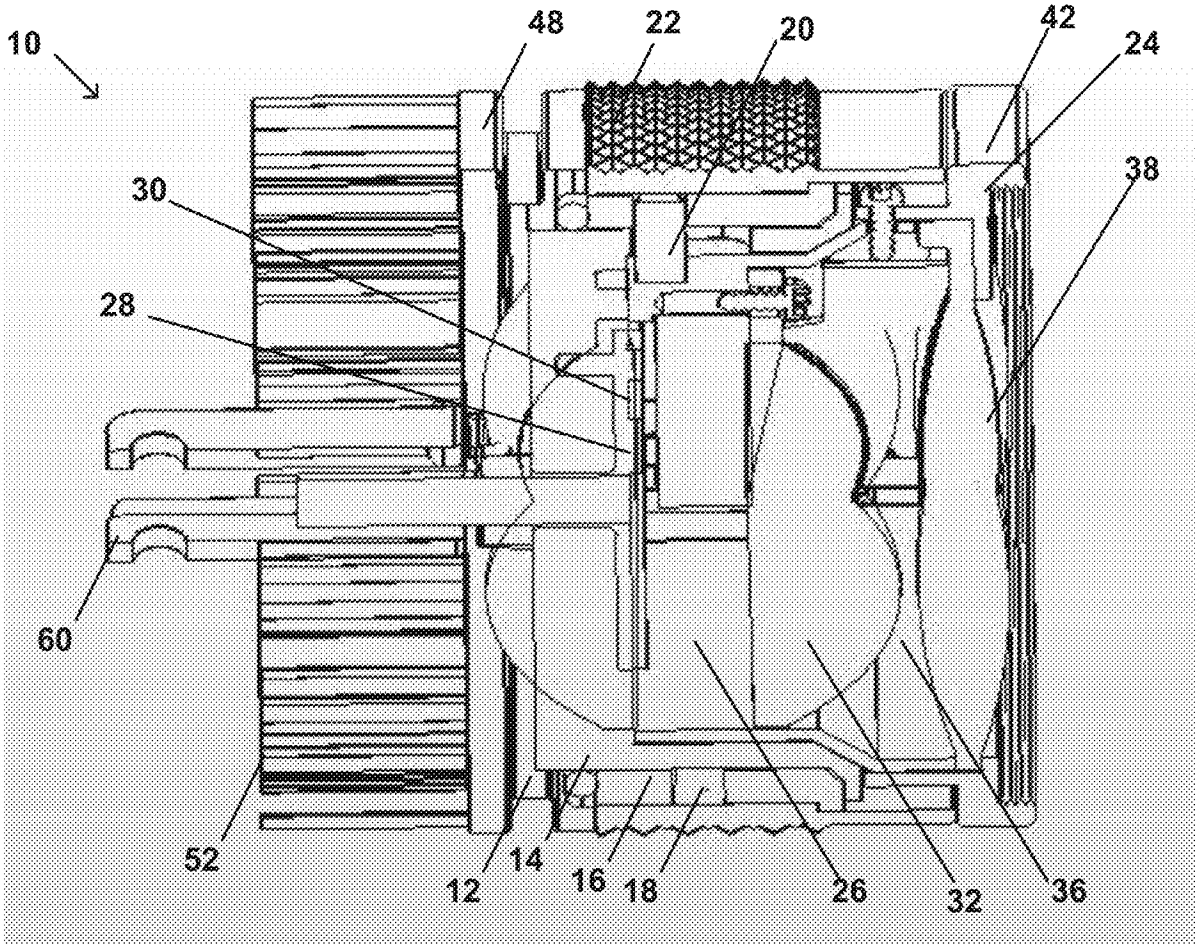
FIG. 6 is a cross-sectional side-view drawing illustrating an exemplary surgical illuminator.

FIG. 6 is a cross-sectional side-view drawing illustrating an exemplary surgical illuminator 10. The surgical illuminator 10 includes a base 12, a guide barrel 14, a cam barrel 16, one or more helical slots 18, a cam roller 20, a grip ring 22, a lens barrel 24, a first lens mask 26, a printed circuit board 28 has three light emitting diodes 30, a triple aspheric lens 32, a second lens mask 36, a triple double-convex lens 38, a triple double-convex lens housing 42, a heat sink 48, cooling fins 52, and an electrical plug 60.

Figure 7:
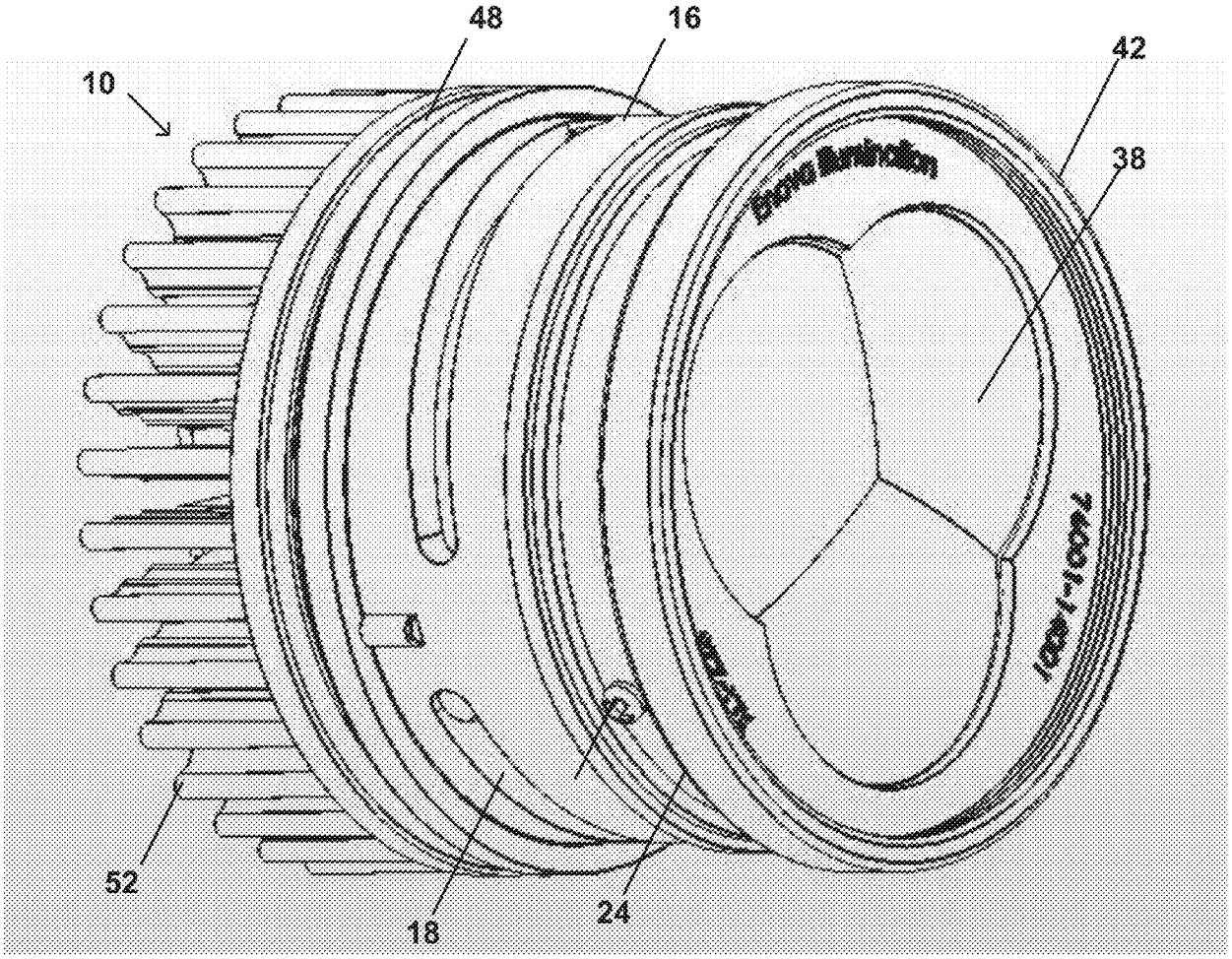
FIG. 7 is a perspective-view drawing illustrating part of an exemplary surgical illuminator.

FIG. 7 is a perspective-view drawing illustrating part of an exemplary surgical illuminator 10. The surgical illuminator 10 includes a base (not shown), a guide barrel (not shown), a cam barrel 16, one or more helical slots 18, a cam roller (not shown), a grip ring (not shown), a lens barrel 24, a printed circuit board (not shown) has three light emitting diodes (not shown), a triple aspheric lens (not shown), a first lens mask (not shown), a second lens mask (not shown), a triple double-convex lens 38, a triple double-convex lens housing 42, a heat sink 48, cooling fins 52, and an electrical plug (not shown).

Figure 8:
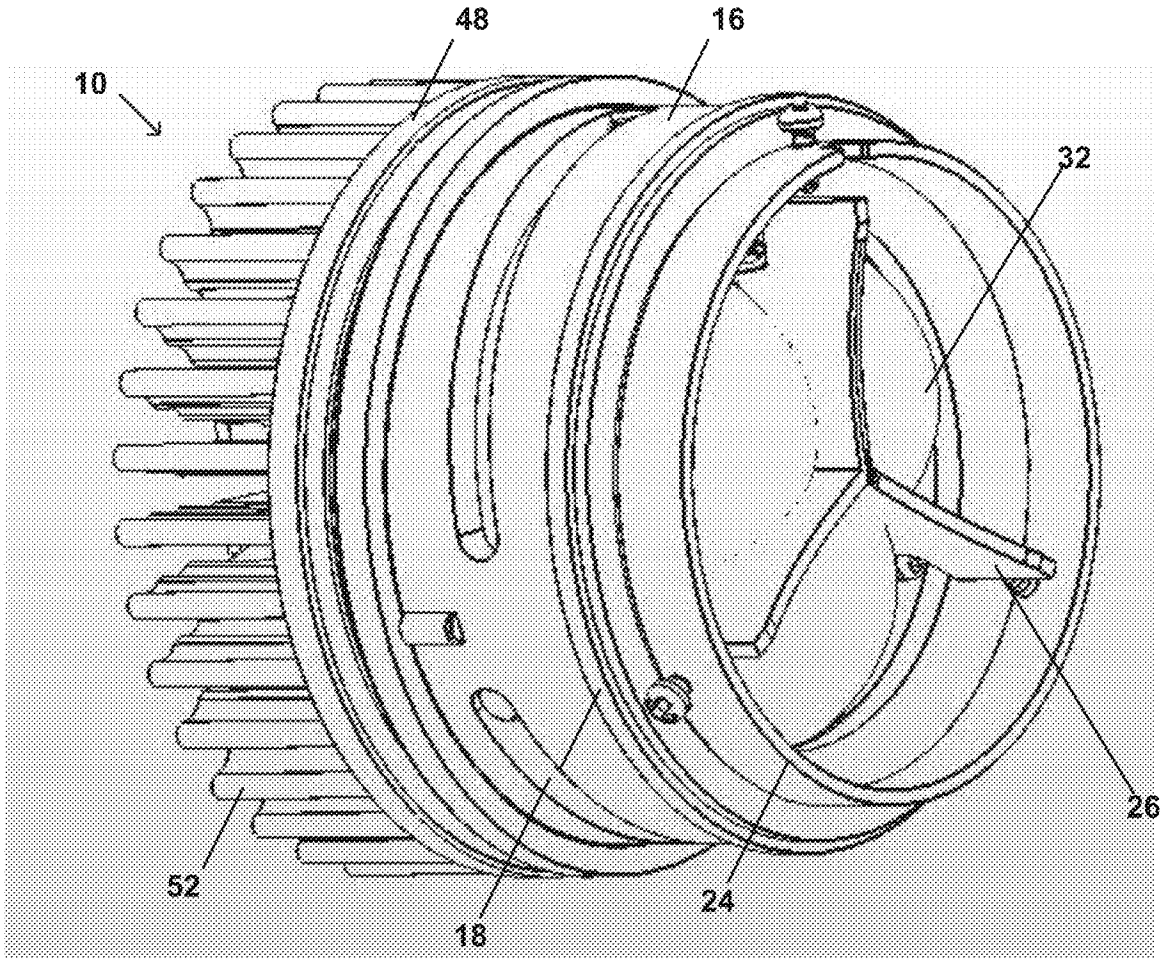
FIG. 8 is a perspective-view drawing illustrating part of an exemplary surgical illuminator.

FIG. 8 is a perspective-view drawing illustrating part of an exemplary surgical illuminator 10. The surgical illuminator 10 includes a base (not shown), a guide barrel (not shown), a cam barrel 16, one or more helical slots 18, a cam roller (not shown), a grip ring (not shown), a lens barrel 24, a first lens mask 26, a printed circuit board (not shown) has three light emitting diodes (not shown), a triple aspheric lens 32, a second lens mask (not shown), a triple double-convex lens 38, a triple double-convex lens housing (not shown), a heat sink 48, cooling fins 52, and an electrical plug (not shown).

Figure 9:
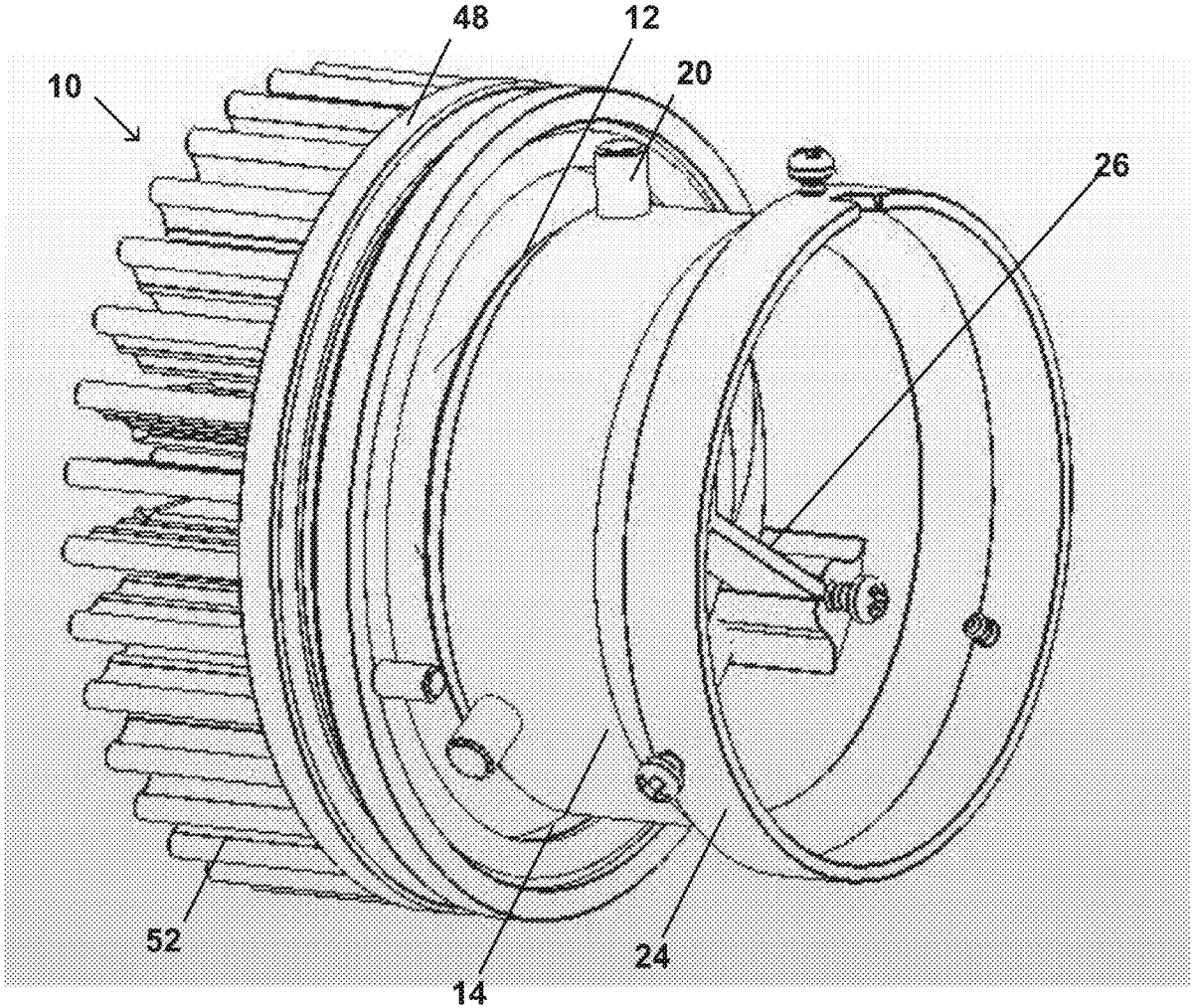
FIG. 9 is a perspective-view drawing illustrating part of an exemplary surgical illuminator.

FIG. 9 is a perspective-view drawing illustrating part of an exemplary surgical illuminator 10. The surgical illuminator 10 includes a base 12, a guide barrel 14, a cam barrel (not shown), one or more helical slots (not shown), a cam roller 20, a grip ring (not shown), a lens barrel 24, a first lens mask 26, a printed circuit board (not shown) has three light emitting diodes (not shown), a triple aspheric lens (not shown), a second lens mask (not shown), a triple double-convex lens (not shown), a triple double-convex lens housing (not shown), a heat sink 48, cooling fins 52, and an electrical plug (not shown).

Figure 10:
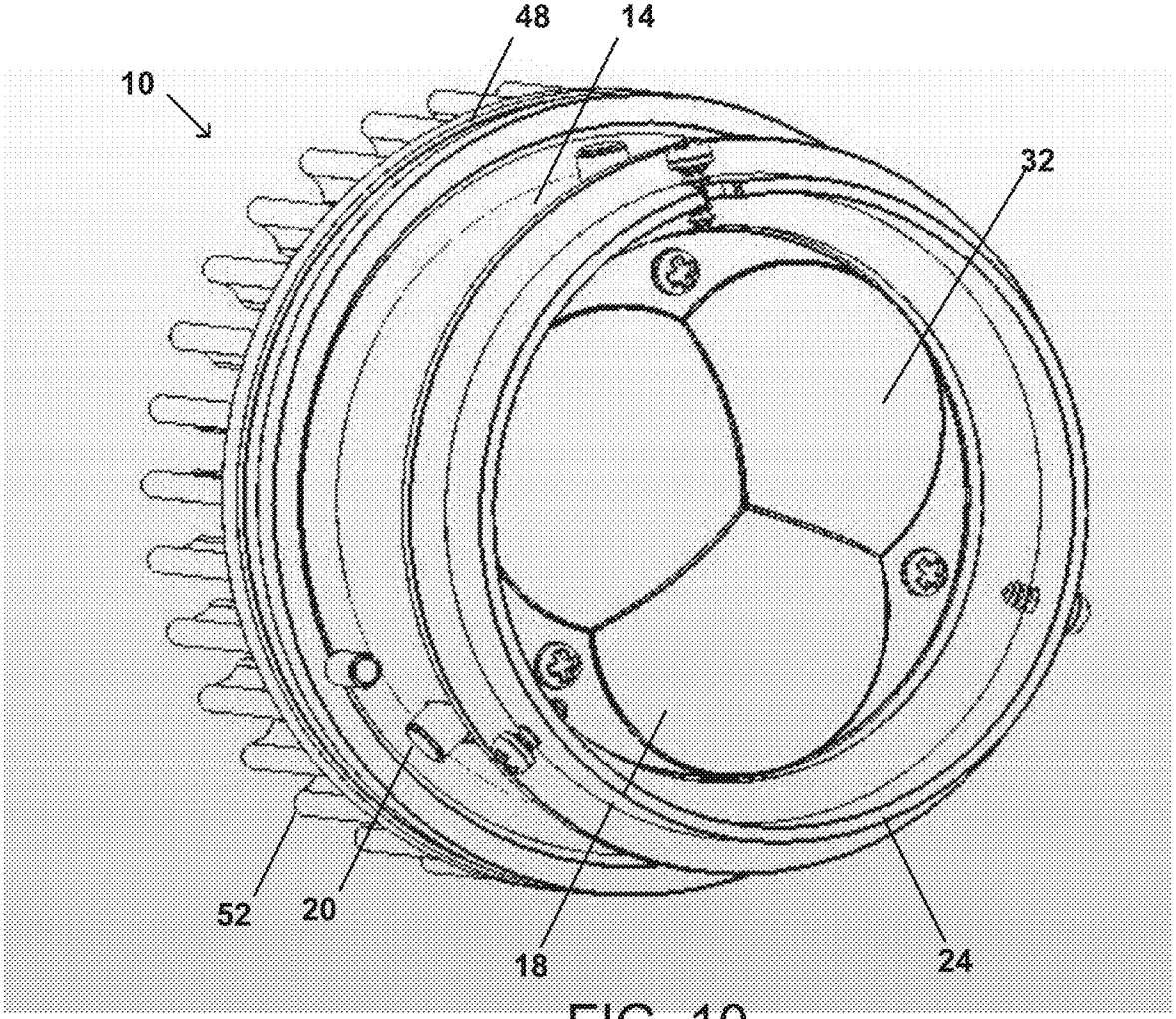
FIG. 10 is a perspective-view drawing illustrating part of an exemplary surgical illuminator.

FIG. 10 is a perspective-view drawing illustrating part of an exemplary surgical illuminator 10. The surgical illuminator 10 includes a base 12, a guide barrel 14, a cam barrel (not shown), one or more helical slots (not shown), a cam roller 20, a grip ring (not shown), a lens barrel 24, a first lens mask 26, a printed circuit board (not shown) has three light emitting diodes (not shown), a triple aspheric lens 32, a second lens mask (not shown), a triple double-convex lens (not shown), a triple double-convex lens housing (not shown), a heat sink 48, cooling fins 52, and an electrical plug (not shown).

Figure 11:
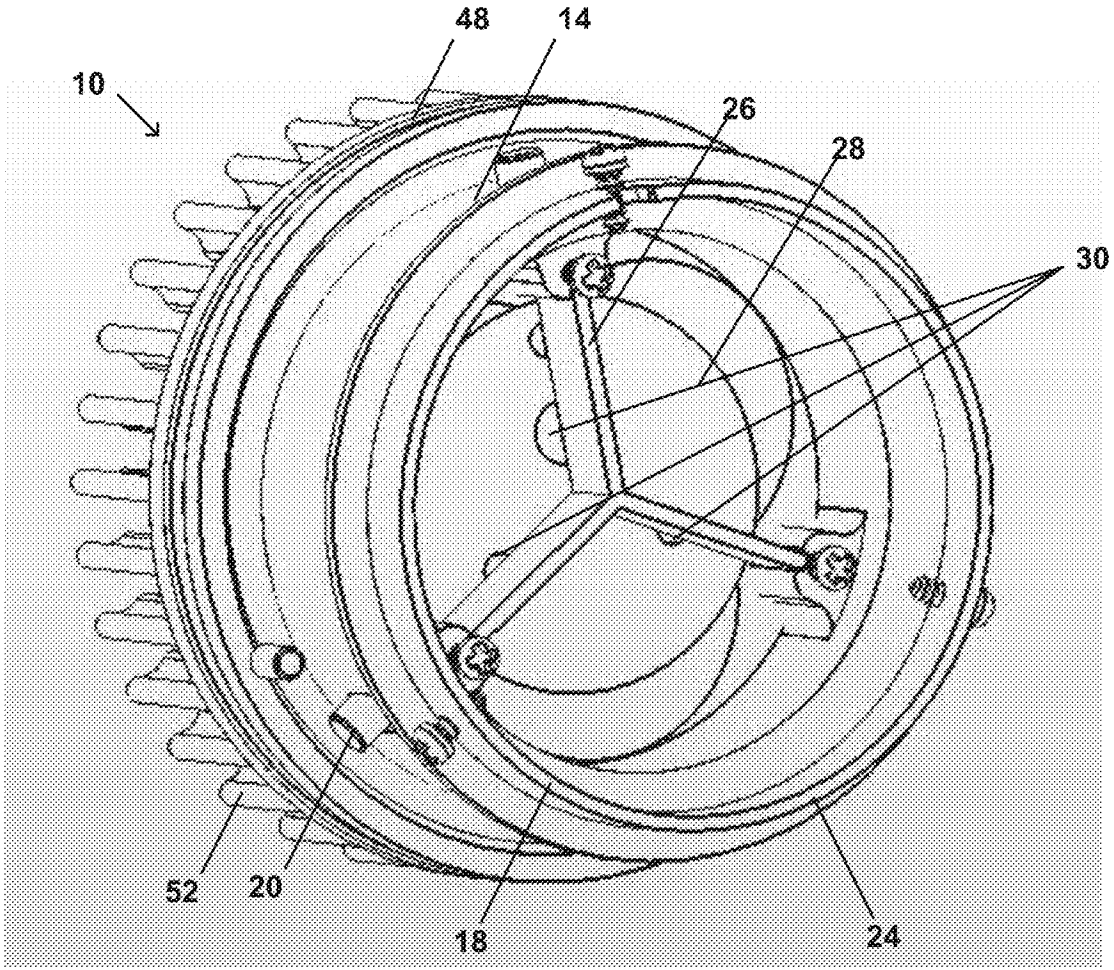
FIG. 11 is a perspective-view drawing illustrating part of an exemplary surgical illuminator.

FIG. 11 is a perspective-view drawing illustrating part of an exemplary surgical illuminator 10. The surgical illuminator 10 includes a base (not shown), a guide barrel 14, a cam barrel (not shown), one or more helical slots (not shown), a cam roller 20, a grip ring (not shown), a lens barrel 24, a first lens mask 26, a printed circuit board 28 has three light emitting diodes 30, a triple aspheric lens (not shown), a second lens mask (not shown), a triple double-convex lens (not shown), a triple double-convex lens housing (not shown), a heat sink 48, cooling fins 52, and an electrical plug (not shown).

Figure 12:
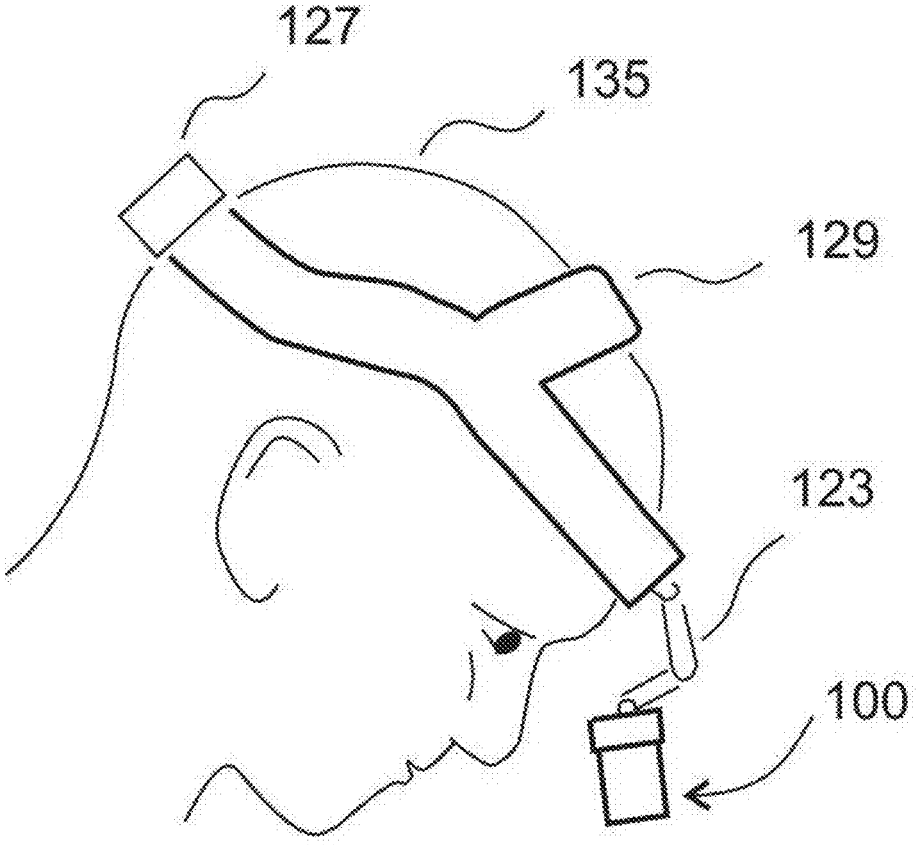
FIG. 12 is a side-view drawing illustrating an exemplary surgical headlamp being worn by a user.

FIG. 12 is a side-view drawing illustrating the surgical illuminator 100 connected to the headlamp mounting bracket 123 mounted on the headband 129 and worn by the user 135.

Figure 13:
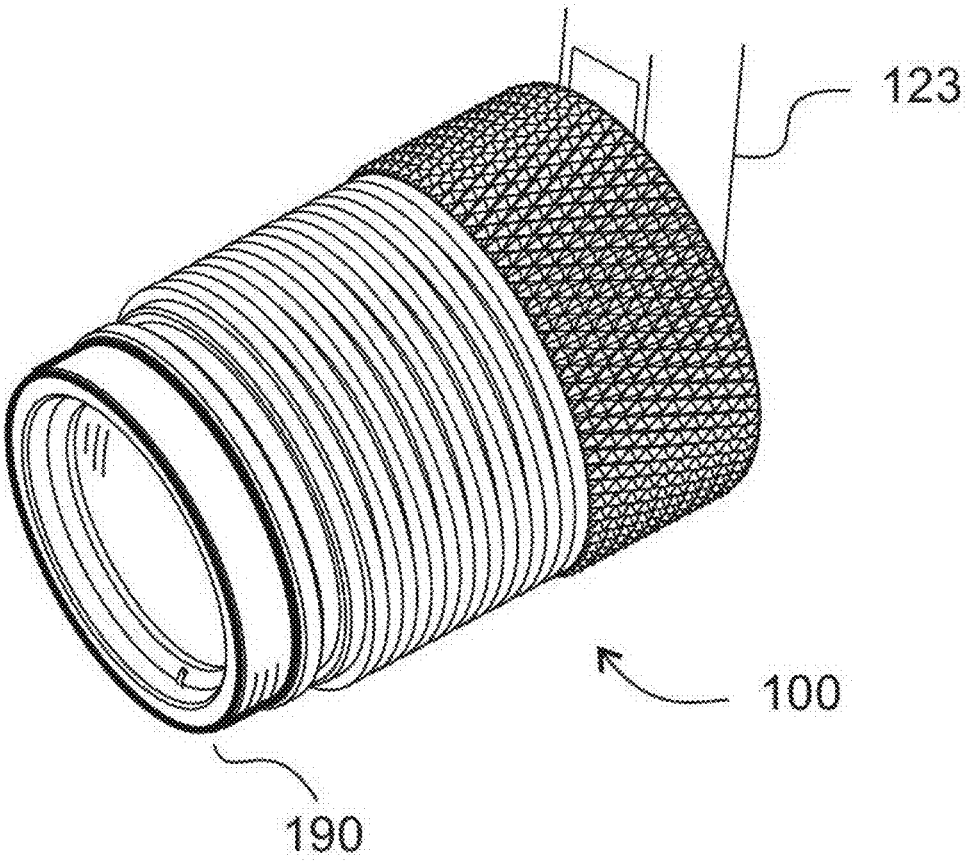
FIG. 13 is a perspective-view drawing illustrating part of an exemplary surgical illuminator with a filter.

FIG. 13 is a perspective view drawing illustrating the headlamp mounting bracket 123 connected to the surgical illuminator 100. A filter 190 is connected to the front of the surgical illuminator 100. In one embodiment, the filter 190 is a camera lens. In one embodiment, the filter 190 is a camera lens of 25 mm. In one embodiment, the filter 190 is a circular polarizer lens. In one embodiment, the filter 190 is a magnification lens. In one embodiment, the filter 190 is a 10× magnification lens. Suitable circular polarizer lens and magnification lens may be obtained from, for example, Opteka (New York, N.Y.).

In one embodiment, the filter 190 is a color temperature filter that adjusts the current color temperature. Without the filter 190, the current color temperature is about 6100K. In one embodiment, the filter 190 is a color temperature filter of about 5500K. In one embodiment, the filter 190 is a color temperature filter of about 5000K. In one embodiment, the filter 190 is a color temperature filter of about 4500K. In one embodiment, the filter 190 is a color temperature filter of about 4000K. In one embodiment, the filter 190 is a color temperature filter of about 3500K.

Suitable color temperature filters may be obtained form, for example. Lee Filters (Andover, N.H.). Suitable color temperature filters are listed under the dichromic polycarbonate filters and may include, for example, filter part numbers 080, 206, 032, 205, and 042. For a discussion of how light can be used to enhance the visual image of tissues, please see, for example, U.S. Pat. No. 5,742,392.

Figure 14:
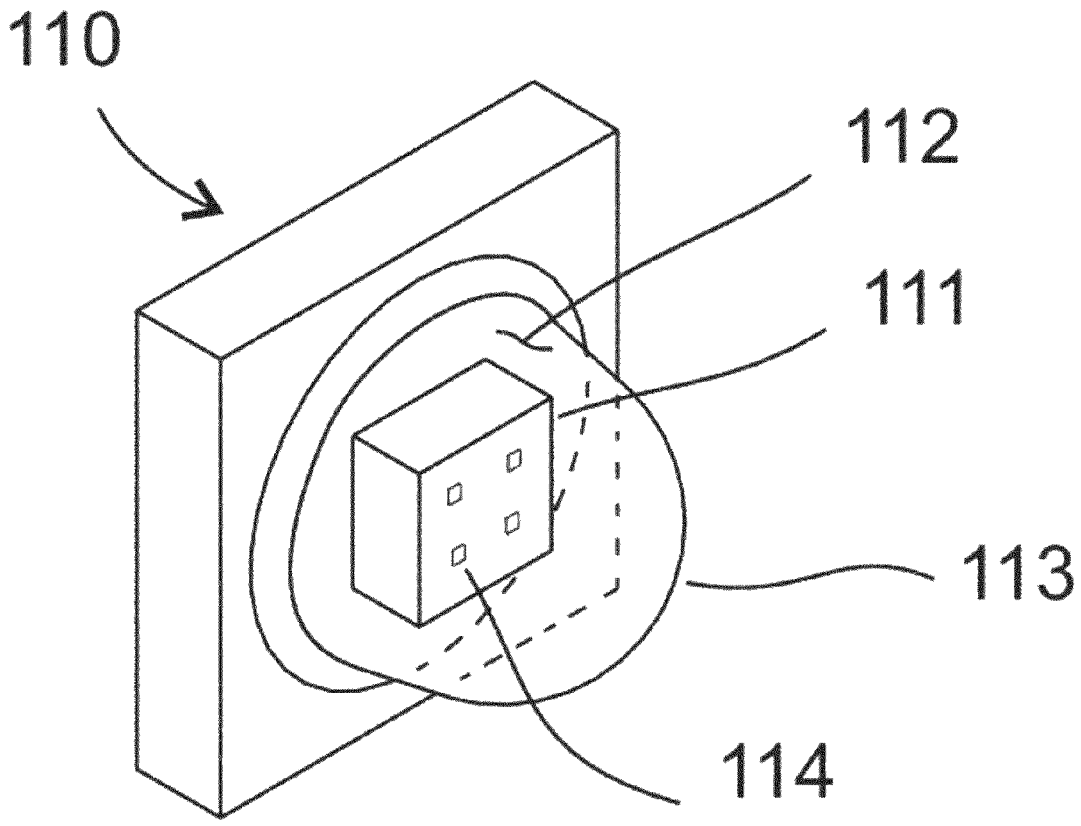
FIG. 14 presents the details of light emitting diode that is used for each of the three light emitting diodes.

FIG. 14 presents the details of light emitting diode 110 that is used in each of the three light emitting diodes 30. The light emitting diode die 111 takes the form of a glowing, extruded square. Some light emerges from the rectangular sides, but the light from the top is usefully directed toward the viewing plane. Metallization artifacts 114 are present on the top, square surface of the light emitting diode die 111, and these cast shadows. In one embodiment, the spherical surface 113 is about a 1 mm radius of curvature, and thus induces considerable focal power to the optical system, rendering a narrow output beam for light emitting diode 110. A suitable light emitting diode 110 for the surgical illuminator 100 may be, for example, part number LCW CQ7P manufactured by OSRAM Corporation (OSRAM GmbH, Munich, Germany). This light emitting diode 110 features a narrow, about 80 degree radiation pattern, and maximum forward current of about 800 mA.

Figure 15:
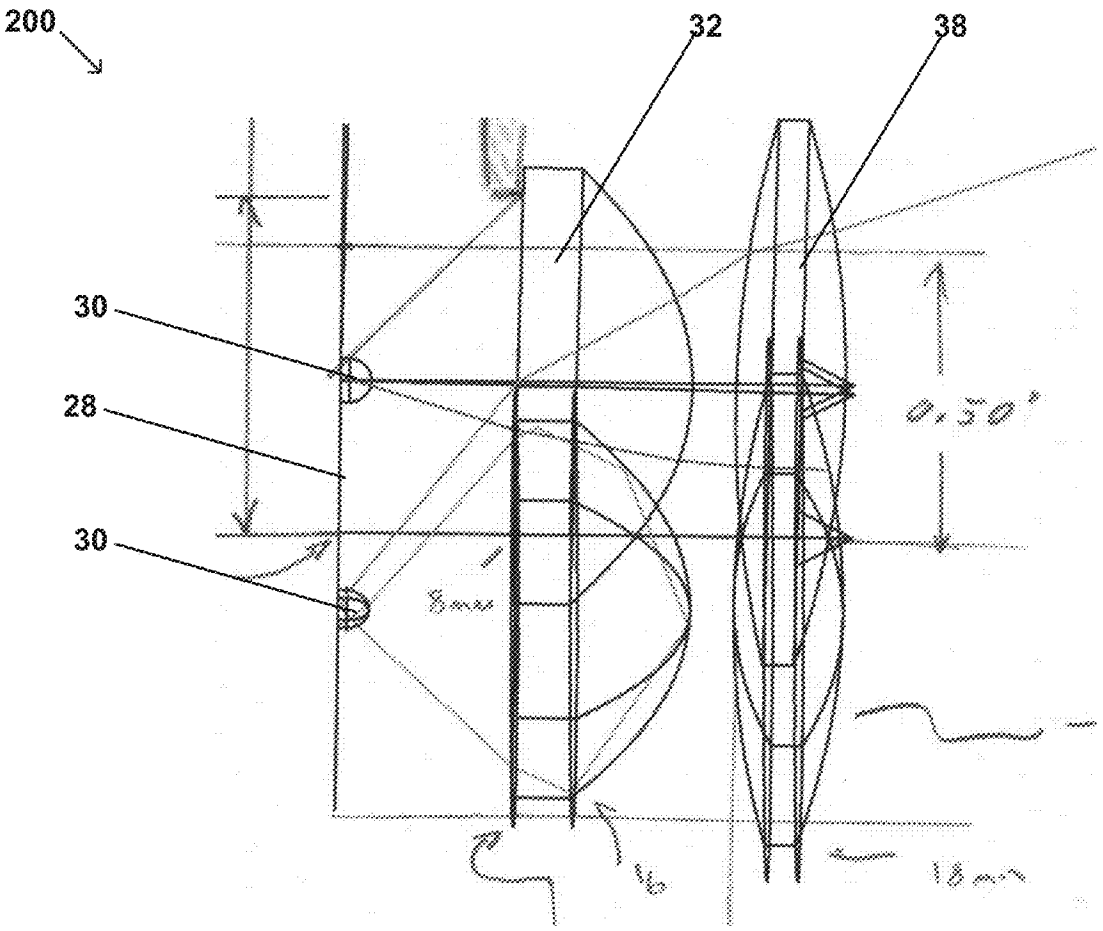
FIG. 15 is a drawing illustrating an exemplary triple optic lens system used in an exemplary surgical illuminator in the form of a ray trace.

FIG. 15 is a drawing illustrating an exemplary triple optic lens system 200 used in an exemplary surgical illuminator, in the form of a ray trace. The triple optic lens system 200 includes the three light emitting diodes 30 on the printed circuit board 28, the triple aspheric lens 32, and the triple double-convex lens 38.

Figure 16:
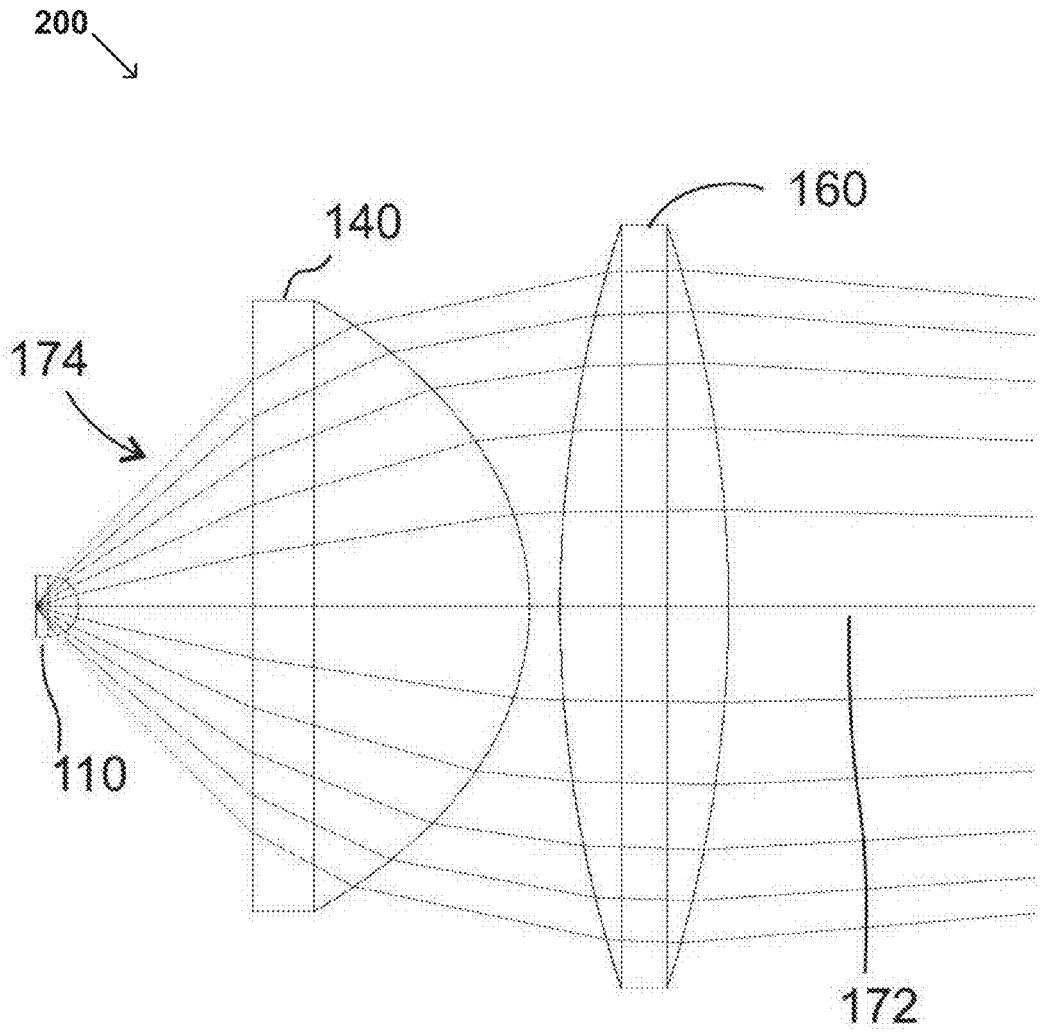
FIG. 16 illustrates the disposition of one section of the triple optic lens system of the surgical illuminator in the form of a ray trace.

FIG. 16 illustrates the disposition of one section 200 of the triple optic lens system of the surgical illuminator in the form of a ray trace. FIG. 16 shows how an evenly spaced fan of rays 174 makes its way from light emitting diode die 111, through light emitting diode spherical surface 113, the aspheric lens 140, and double-convex lens 160.

Figure 17:
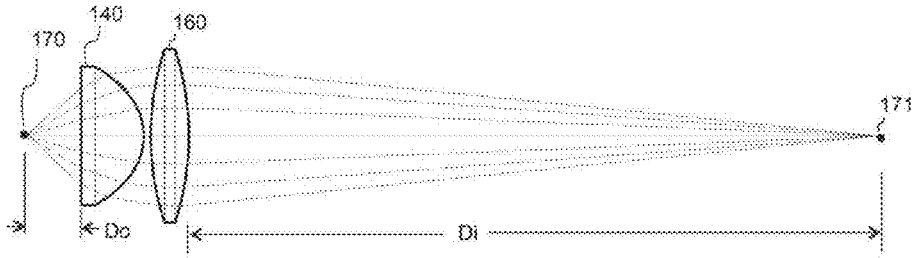
FIG. 17 illustrates the optical details of how the one section of the triple optic lens system is configured in one embodiment.

FIG. 17 illustrates the optical details of how the one section 200 of the triple optic lens system is configured in one embodiment. The lens surfaces are designed so that an object at object focal point 170 that is about 8 mm from the planar surface 141 of the aspheric lens 140 focuses to an image design focal point 171 that is about 100 mm from outside surface of double-convex lens 160. The distance from double-convex lens 160 to image focal point 171 is referred to as Di. In FIG. 17, the object distance (Do) is about 8 mm and Di is about 100 mm. The optical system is symmetric about an optical axis 172. The positioning of the components is optimized using optical Computer-Aided Design (CAD) software such as Zemex, produced by Radiant Zemax (Radiant Zemax, Redmond, Wash., USA). The design configuration is not the operational configuration, as will be discussed herein below. In operation, the object distance (Do) is allowed to vary. Also, the image or viewing plane in operation is typically about 14 inches (35 cm), which is much greater than the image design focal point.

The details of the design optimization for the one section 200 of the triple optic lens system are typical for the surgical illuminator 10 to achieve its design objectives. Specifically, the designed focal point 170 presents a very narrow depth of focus. That is, even a small displacement of an object at object focal point 170 will cause the system to go out of focus. Next, planar surface 141 of aspheric lens 140 forms the optimal shape. A concave surface would gather more rays, and thus be brighter, but it would not permit the narrow depth of focus of the surgical illuminator 100. A convex surface would sacrifice brightness. Additionally, a convex surface would increase the system magnification, which would mean that it could only achieve a larger minimum spot size. The optical configuration of the surgical illuminator 100 makes the steepest deflections of the rays at the planar 141 and convex 142 surfaces the aspheric lens 140. This configuration allows aspheric lens convex surface 141 to properly correct for spherical aberration. The double-convex lens 160 is left to do less of the work, because its aberrations are not corrected for. The double-convex lens 160 does, however, induce an additional 13 diopters of focal power into the optical system, contributing the narrow depth of focus.

During the operation of the surgical illuminator 10, referring to FIG. 14 for one section 200 of the triple optic lens system, the light emitting diode die 111 glows brightly causing the light rays 174 to be generated in all directions. A fan of such rays is presented, and they exit light emitting diode die 111 at surface 113. The rays 174 strike planar surface 141 of aspheric lens 140, and are deflected toward optical axis 172. Then, the rays 174 exit aspheric lens 140 at the convex surface 142, further bending toward optical axis 172. The inside surface of the double-convex lens 161 and the outside surfaces of double-convex lens 162 further deflect rays 174, and rays 174 emerge from the surgical illuminator 10 convergent.

The object distance (Do) may be adjusted by rotating lens barrel 24, as may be seen in FIGS. 5-6. The cam rollers 20 engage helical slots 18, causing lens barrel 24 to move longitudinally with respect to base 12. The surgeon makes such an adjustment to set the spot size of the surgical illuminator 10.

Figure 18:
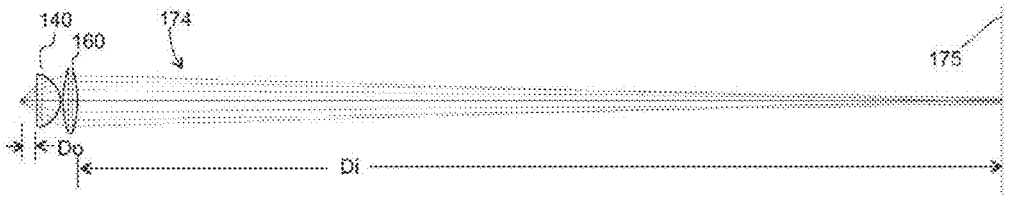
FIG. 18 show a ray trace for one section of the triple optic lens system of the surgical illuminator adjusted for minimum spot size.

FIG. 18 show a ray trace for one section 200 of the triple optic lens system of the surgical illuminator 10 adjusted for minimum spot size. So adjusted, Do is reduced to considerably less than the design focal point distance, so Do is about 4 mm. This causes the image focal point 171 to coincide with an image or viewing plane 175. In one embodiment, the viewing plane 175 is about 360 mm from double-convex lens 160 and the Di is about 360. In one embodiment, the light emitting diode die 111 is a square about 1 mm on each side and the illumination system provides magnification. So adjusted, the minimum spot size is about 1.5 inches (38 mm) in diameter, and with a peak brightness of about 125K lux. This is within the range of brightness produce by the fiber-optic illuminators that surgeons are familiar with.

The illumination spot formed on image plane is round and with sharp edges. The reason that the spot is round is that, when properly adjusted, object focal point 170 is positioned at the top of light emitting diode body 112. The top of light emitting diode body 112 presents a round, uniform surface 113 of the image onto the viewing plane 175. The light emitting diode die 111 is about 1 mm more distant from the aspheric lens 140. Because the depth of focus of the system is so narrow, the light emitting diode die 111 is effectively out of focus. This blurs together the light emitting diode die 111 surface anomalies such as metallization masks 114, wire bonds, or die imperfections. The resulting illumination is thus very high quality and uniform.

Figure 19:
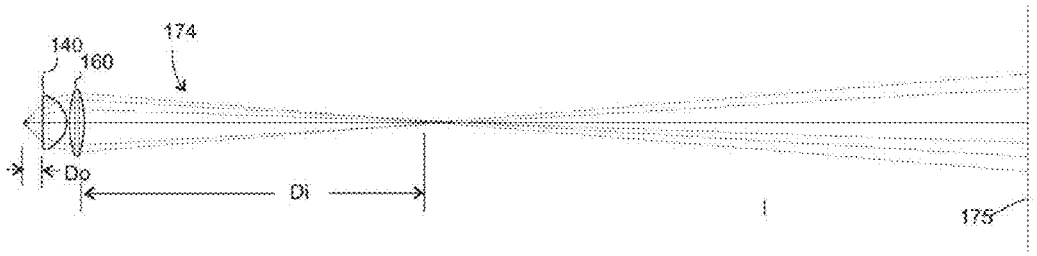
FIG. 19 shows a ray trace for one section of the triple optic lens system of the surgical illuminator when it is adjusted for a large spot size.

FIG. 19 shows a ray trace for one section 200 of the triple optic lens system of the surgical illuminator 10 when it is adjusted for a large spot size. The base 12 is moved so that each of the light emitting diode die 111 is about 8 mm from each aspheric lens 140 in the triple aspheric lens 32, or Do is about 8 mm. This movement is accomplished by rotating lens barrel 24 (See, e.g., FIGS. 5-6). Because there are three evenly cam rollers 20 with corresponding helical slots 18, the movement is smooth and the forces evenly distributed. This brings image focal point 171 in to a distance of about 100 mm, so Di is about 100 mm. As seen in the FIG. 19, rays 175 converge to image focal point 171, cross, and then diverge until they hit viewing plane 173. This operation is in contrast to conventional light emitting diode illuminators, which generally become more divergent when adjusted for larger spot size. The surgical illuminator 10 features a lower system magnification when adjusted for larger spot size. This at least partly compensates for the blurring effect from bringing the image focal point far from the viewing plane. By so doing, surgical illuminator 10 maintains reasonably sharp edges for the illumination spot, even when adjusted for maximum spot size.

Figure 20:
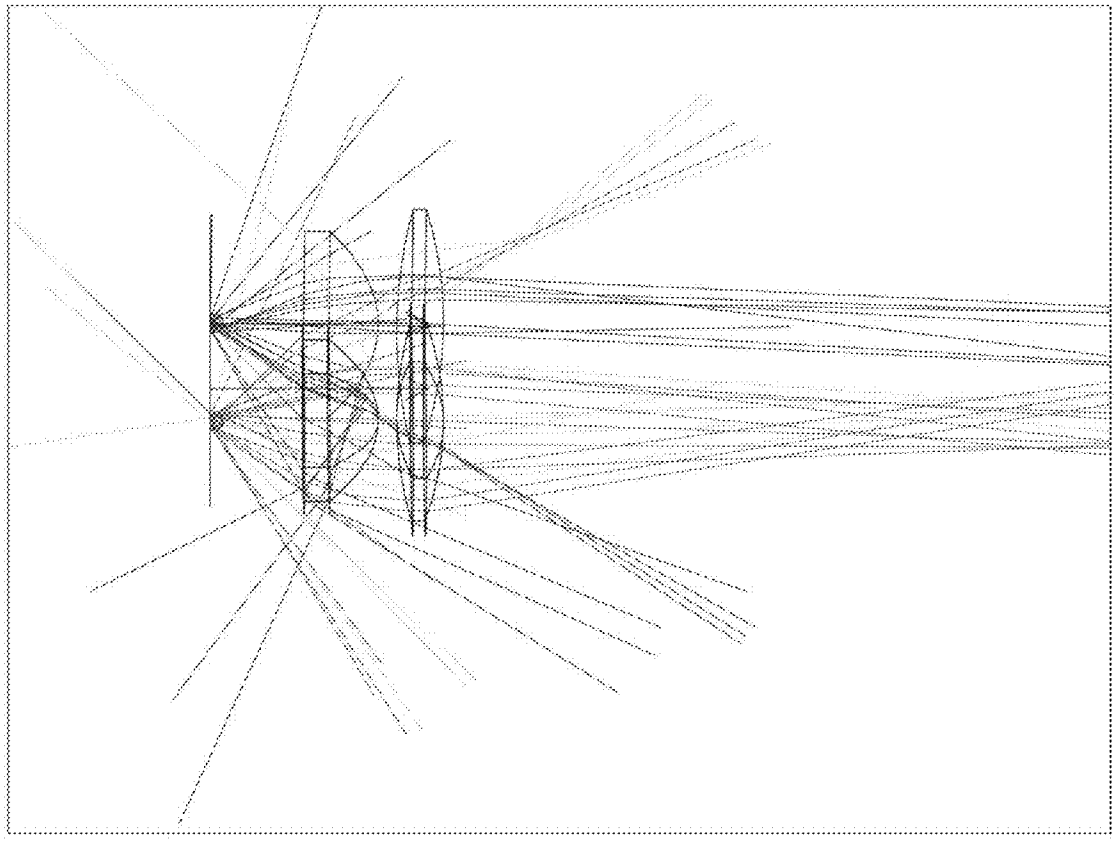
FIG. 20 is a ray trace further illustrating the performance of an exemplary surgical illuminator.

FIG. 20 is a ray trace further illustrating the performance of an exemplary surgical illuminator 10. The rays emanating in random directions from each of the three LEDs are traced in a nonsequential fashion. That is, the ray tracking software makes not assumptions as to which optical surface each ray will strike next. The figures illustrates that a large fraction of the rays strike the appropriate surfaces and are sent in the proper direction for useful illumination.

Figure 21:
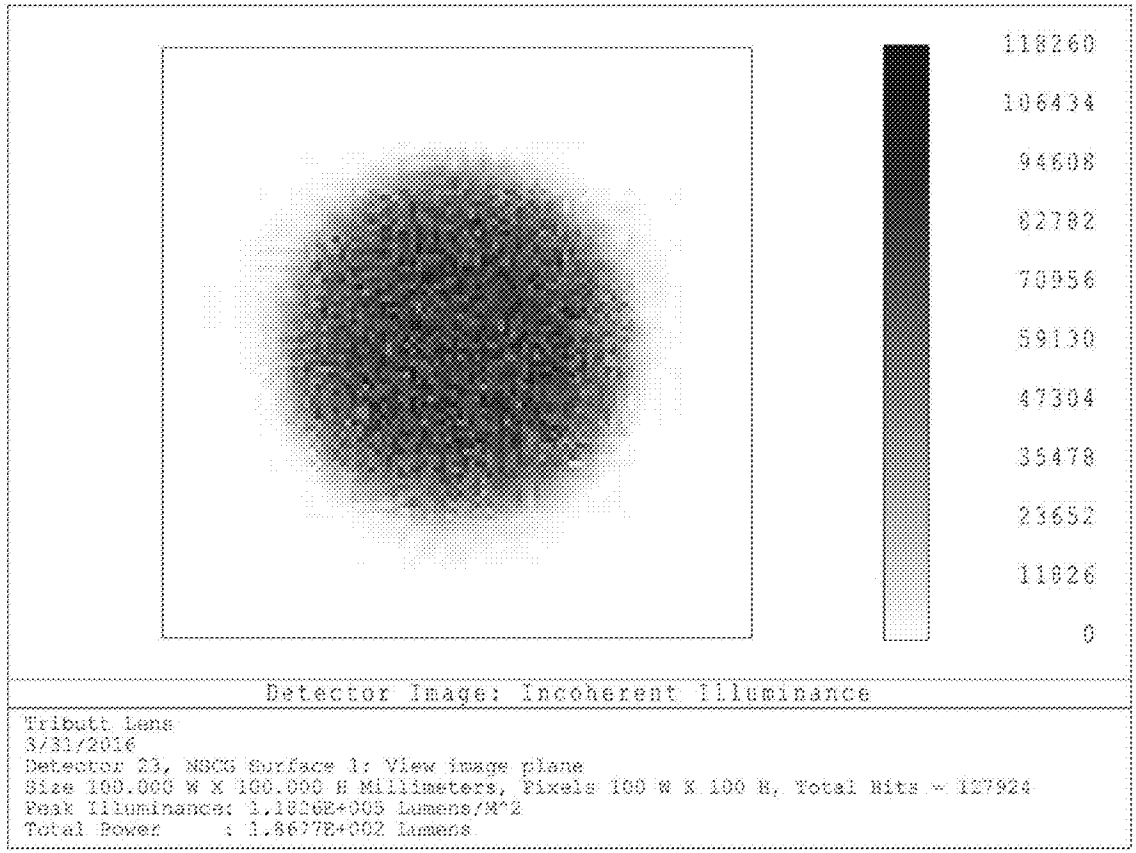
FIG. 21 is a top-view drawing illustrating an exemplary spot produced by an exemplary surgical illuminator adjusted for small diameter output.

FIG. 21 is a top-view drawing illustrating an exemplary spot produced by an exemplary surgical illuminator adjusted for small diameter output. The figure was generated using Zemax optical computer-aided design software, tracing random rays emanation from the LEDs. The figure illustrates that the surgical illuminator produces a uniform small spot with reasonably sharp edges. Experiments with a prototype of the invention reveal that the actual performance of the device closely matches the computer simulation.

Figure 22:
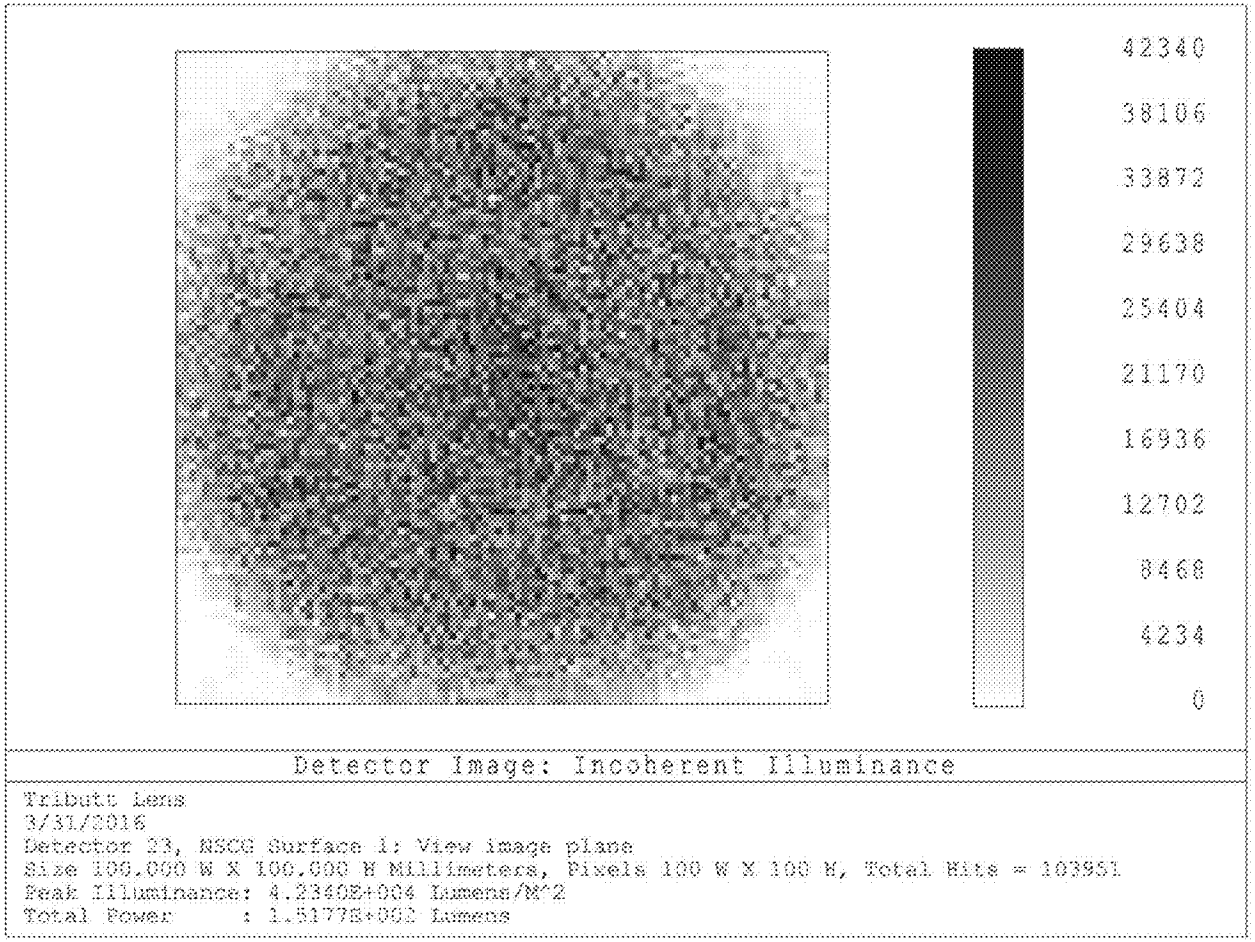
FIG. 22 is a top-view drawing illustrating an exemplary spot produced by an exemplary surgical illuminator adjusted for large diameter output.

FIG. 22 is a top-view drawing illustrating an exemplary spot produced by an exemplary surgical illuminator adjusted for large diameter output. The figure is produced using computer ray tracing similar to that of FIG. 21, but with the computer model adjusted so simulate the cam being positioned so as to maximize Do. The figure illustrates that the invention produces a large illumination spot size. The invention may be continuously adjusted to achieve spot sizes in between that shows in FIGS. 21 and 22.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance or component fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A surgical illuminator comprising a base having a proximal end, a distal end, a first surface, a second surface, and a third surface;

a guide barrel having a proximal end, a distal end, a first surface, and a second surface, wherein the first surface of the guide barrel is adjacent to the third surface of the base, wherein the second surface of the guide barrel is configured to accept a first surface of a cam barrel having a proximal end, a distal end, a first surface, and a second surface, wherein the cam barrel comprises one or more helical slots each independently spanning about 270 degrees, wherein the guide barrel and the cam barrel are each independently configured to accept a cam roller;

a grip ring having a proximal end, a distal end, a first surface, and a second surface, wherein the first surface of the grip ring is configured to accept the second surface of the cam barrel:

a lens barrel having a proximal end, a distal end, a first surface, and a second surface, wherein the first surface of the lens barrel is configured to retain a first lens mask having a proximal end and a distal end, wherein the second surface of the lens barrel is adjacent to the first surface of the guide barrel;

a printed circuit board having a first surface and a second surface, wherein the first surface of the printed circuit board comprises three symmetrically distributed light emitting diodes, wherein the second surface of the printed circuit board is facing the first surface of the base, wherein the first surface of the printed circuit board is facing the distal end of the first lens mask;

a triple aspheric lens having a proximal end, a distal end, a first surface, a second surface, and a third surface, wherein the second surface of the triple aspheric lens is planar and in contact with the proximal end of the first lens mask, wherein the first surface of the triple aspheric lens comprises three symmetrically distributed convex surfaces:

a second lens mask having a proximal end, a distal end, a first surface, and a second surface, wherein the second lens mask is configured to accept three convex surfaces of the triple aspheric lens;

a triple double-convex lens having a proximal end, a distal end, a first surface, a second surface, and a third surface, wherein the triple double-convex lens comprises three symmetrically distributed double-convex surfaces, wherein the distal end of the triple double-convex lens is adjacent to the proximal end of the second lens mask:

a triple double-convex lens housing having a proximal end, a distal end, a first surface, a second surface, and a third surface, wherein the triple double-convex lens is mounted axially inside the triple double-convex lens housing so that the third surface of the triple double-convex lens is adjacent to the first surface of the triple double-convex lens housing, and wherein the first surface of the triple double-convex lens housing is configured to accept the second surface of the lens barrel.

2. The surgical illuminator of claim 1, wherein the guide barrel and the cam barrel are each independently configured to accept a cam roller extending through the guide barrel and the cam barrel.

3. The surgical illuminator of claim 1, wherein the second surface of the grip ring comprises a knurled surface.

4. The surgical illuminator of claim 1, wherein the first lens mask comprises a symmetrical three 3-prong first lens mask and wherein the second lens mask comprises a symmetrical 3-prong second lens mask.

5. The surgical illuminator of claim 1, wherein the three symmetrically distributed light emitting diodes each independently feature about an 80 degree radiation pattern, and maximum forward current of about 800 mA.

6. The surgical illuminator of claim 1, further comprising a power source operatively connected to the printed circuit board and an on/off switch.

7. The surgical illuminator of claim 1, wherein a distance (Do) between the second surface of the printed circuit board and a planar surface of the triple aspheric lens is about 8 mm.

8. The surgical illuminator of claim 1, wherein each of the symmetrically distributed convex surfaces of the triple aspheric lens each independently has a diameter of about 16 mm and a focal length of about 17.5 mm and wherein each of the symmetrically distributed convex surfaces of the triple double-convex lens has a diameter of about 18 mm and a focal length of about 75 mm.

9. The surgical illuminator of claim 1, further comprising a heat sink having a proximal end, a distal end, a first surface, and a second surface, wherein the first surface of the heat sink is configured to accept an O-ring and wherein the second surface of the heat sink comprises one or more cooling fins.

10. A surgical illuminator comprising a cylindrical base having a proximal end, a distal end, a first surface, a second surface, and a third surface;

a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel comprises one or more helical slots each independently spanning about 270 degrees, wherein the cylindrical guide barrel and the cylindrical cam barrel are each independently configured to accept a cam roller extending through the cylindrical guide barrel and the cylindrical cam barrel:

a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring comprises a knurled surface;

a cylindrical lens barrel having a proximal end, a distal end, a first surface, and a second surface, wherein the first surface of the cylindrical lens barrel is configured to retain a first lens mask having a proximal end and a distal end, wherein the first lens mask comprises a symmetrical three 3-prong first lens mask;

wherein the second surface of the cylindrical lens barrel is adjacent to the first surface of the cylindrical guide barrel;

a printed circuit board having a first surface and a second surface, wherein the first surface of the printed circuit board comprises three symmetrically distributed light emitting diodes, wherein the second surface of the printed circuit board is facing the first surface of the cylindrical base, wherein the first surface of the printed circuit board is facing the distal end of the first lens mask:

a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens comprises three symmetrically distributed convex surfaces;

a second lens mask having a proximal end, a distal end, a first surface, and a second surface, wherein the second lens mask is configured to accept three convex surfaces of the triple aspheric cylindrical lens, wherein the second lens mask comprises a symmetrical 3-prong second lens mask;

a triple double-convex cylindrical lens having a proximal end, a distal end, a first surface, a second surface, and a third surface, wherein the triple double-convex cylindrical lens comprises three symmetrically distributed double-convex surfaces, wherein the distal end of the triple double-convex cylindrical lens is adjacent to the proximal end of the second lens mask;

a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel.

11. The surgical illuminator of claim 10, wherein the three symmetrically distributed light emitting diodes each independently feature about an 80 degree radiation pattern, and maximum forward current of about 800 mA.

12. The surgical illuminator of claim 10, further comprising a power source operatively connected to the printed circuit board and an on/off switch.

13. The surgical illuminator of claim 10, wherein a distance (Do) between the second surface of the printed circuit board and a planar surface of the triple aspheric cylindrical lens is from about 8 mm.

14. The surgical illuminator of claim 10, wherein each of the symmetrically distributed convex surfaces of the triple aspheric cylindrical lens each independently has a diameter of about 16 mm and a focal length of about 17.5 mm and wherein each of the symmetrically distributed convex surfaces of the triple double-convex cylindrical lens has a diameter of about 18 mm and a focal length of about 75 mm.

15. The surgical illuminator of claim 10, further comprising a heat sink having a proximal end, a distal end, a first surface, and a second surface, wherein the first surface of the heat sink is configured to accept an O-ring and wherein the second surface of the heat sink comprises one or more cooling fins.

16. A surgical illuminator comprising:

a heat sink having a proximal end, a distal end, a first surface, and a second surface, wherein the first surface of the heat sink is configured to accept an O-ring, wherein the second surface of the heat sink comprises one or more cooling fins;

a cylindrical base having a proximal end, a distal end, a first surface, a second surface, and a third surface, wherein the second surface of the cylindrical base is facing the first surface of the heat sink:

a cylindrical guide barrel having a proximal end, a distal end, a first surface, and a second surface, wherein the first surface of the cylindrical guide barrel is adjacent to the third surface of the cylindrical base, wherein the second surface of the cylindrical guide barrel is configured to accept a first surface of a cylindrical cam barrel having a proximal end, a distal end, a first surface, and a second surface, wherein the cylindrical cam barrel comprises one or more helical slots each independently spanning about 270 degrees, wherein the cylindrical guide barrel and the cylindrical cam barrel are each independently configured to accept a cam roller extending through the cylindrical guide barrel and the cylindrical cam barrel;

a cylindrical grip ring having a proximal end, a distal end, a first surface, and a second surface, wherein the first surface of the cylindrical grip ring is configured to accept the second surface of the cylindrical cam barrel, wherein the second surface of the cylindrical grip ring comprises a knurled surface;

a cylindrical lens barrel having a proximal end, a distal end, a first surface, and a second surface, wherein the first surface of the cylindrical lens barrel is configured to retain a first lens mask having a proximal end and a distal end, wherein the first lens mask comprises a symmetrical three 3-prong first lens mask;

wherein the second surface of the cylindrical lens barrel is adjacent to the first surface of the cylindrical guide barrel:

a printed circuit board having a first surface and a second surface, wherein the first surface of the printed circuit board comprises three symmetrically distributed light emitting diodes, wherein the second surface of the printed circuit board is facing the first surface of the cylindrical base, wherein the first surface of the printed circuit board is facing the distal end of the first lens mask;

a triple aspheric cylindrical lens having a proximal end, a distal end, a first surface, a second surface, and a third surface, wherein the second surface of the triple aspheric cylindrical lens is planar and in contact with the proximal end of the first lens mask, wherein the first surface of the triple aspheric cylindrical lens comprises three symmetrically distributed convex surfaces;

a second lens mask having a proximal end, a distal end, a first surface, and a second surface, wherein the second lens mask is configured to accept three convex surfaces of the triple aspheric cylindrical lens, wherein the second lens mask comprises a symmetrical 3-prong second lens mask;

a triple double-convex cylindrical lens having a proximal end, a distal end, a first surface, a second surface, and a third surface, wherein the triple double-convex cylindrical lens comprises three symmetrically distributed double-convex surfaces, wherein the distal end of the triple double-convex cylindrical lens is adjacent to the proximal end of the second lens mask;

a triple double-convex cylindrical lens housing having a proximal end, a distal end, a first surface, a second surface, and a third surface, wherein the triple double-convex cylindrical lens is mounted axially inside the triple double-convex cylindrical lens housing so that the third surface of the triple double-convex cylindrical lens is adjacent to the first surface of the triple double-convex cylindrical lens housing, and wherein the first surface of the triple double-convex cylindrical lens housing is configured to accept the second surface of the cylindrical lens barrel.

17. The surgical illuminator of claim 16, wherein the three symmetrically distributed light emitting diodes each independently feature about an 80 degree radiation pattern, and maximum forward current of about 800 mA.

18. The surgical illuminator of claim 16, further comprising a power source operatively connected to the printed circuit board and an on/off switch.

19. The surgical illuminator of claim 16, wherein a distance (Do) between the second surface of the printed circuit board and a planar surface of the triple aspheric cylindrical lens is from about 8 mm.

20. The surgical illuminator of claim 18, wherein each of the symmetrically distributed convex surfaces of the triple aspheric cylindrical lens each independently has a diameter of about 16 mm and a focal length of about 17.5 mm and wherein each of the symmetrically distributed convex surfaces of the triple double-convex cylindrical lens has a diameter of about 18 mm and a focal length of about 75 mm.

* * * * *